US007789986B2

(12) United States Patent
Brown et al.

(10) Patent No.: US 7,789,986 B2
(45) Date of Patent: Sep. 7, 2010

(54) PROCESS AND APPARATUS FOR EDGE WRAPPING UPHOLSTERED ARTICLES

(75) Inventors: Ronald H. Brown, Holland, MI (US); Randolph Woellper, Hudsonville, MI (US)

(73) Assignee: Haworth, Inc., Holland, MI (US)

( * ) Notice: Subject to any disclaimer, the term of this patent is extended or adjusted under 35 U.S.C. 154(b) by 1185 days.

(21) Appl. No.: 11/369,171

(22) Filed: Mar. 6, 2006

(65) Prior Publication Data

US 2007/0214625 A1 Sep. 20, 2007

(51) Int. Cl.
*B32B 3/04* (2006.01)

(52) U.S. Cl. ..... 156/216; 156/213; 156/475; 156/477.1; 156/478; 156/479

(58) Field of Classification Search ..... 156/478, 156/479, 216, 213, 475, 477.1
See application file for complete search history.

(56) References Cited

U.S. PATENT DOCUMENTS

| | | | | |
|---|---|---|---|---|
| RE17,231 | E | | 3/1929 | Roline et al. |
| 1,833,702 | A | | 11/1931 | Anthony |
| 2,489,118 | A | | 11/1949 | Brinker et al. |
| 2,576,121 | A | | 11/1951 | Kamborian |
| 2,808,099 | A | | 10/1957 | Silverman |
| 3,840,167 | A | | 10/1974 | Otteman et al. |
| 4,248,657 | A | * | 2/1981 | Henry ..... 156/443 |
| 4,995,178 | A | | 2/1991 | Randolph |
| 5,072,496 | A | | 12/1991 | Radermacher |
| 5,118,374 | A | * | 6/1992 | Suwitoadji ..... 156/216 |
| 5,129,569 | A | | 7/1992 | Stanton |
| 5,230,687 | A | | 7/1993 | Lombardo et al. |
| 5,258,083 | A | * | 11/1993 | Monk et al. ..... 156/64 |
| 5,259,825 | A | | 11/1993 | De Angelis et al. |
| 6,581,260 | B2 | * | 6/2003 | Kinney ..... 29/91.1 |

* cited by examiner

*Primary Examiner*—Khanh Nguyen
*Assistant Examiner*—Vishal I Patel
(74) *Attorney, Agent, or Firm*—Flynn, Thiel, Boutell & Tanis, P.C.

(57) ABSTRACT

A manufacturing apparatus and process to effect substantial automatic wrapping of the edges of a covered article, namely, the wrapping of cover sheet flaps around the edges of a substrate and the adhesive securement of the cover sheet flaps to the back side of the substrate, to form an upholstered article such as a pad or panel in a highly automated process which eliminates significant manual manipulations.

4 Claims, 31 Drawing Sheets

PROCESS AND APPARATUS FOR EDGE WRAPPING UPHOLSTERED ARTICLES

FIELD OF THE INVENTION

This invention relates to a process and apparatus for wrapping a thin flexible covering sheet around the edges of a substrate and, more specifically, to an improved process and apparatus for wrapping a thin sheetlike covering such as a fabric sheet around the edges of a relatively stiff or rigid panel-like member to form a covered or upholstered article such as a pad or panel.

BACKGROUND OF THE INVENTION

Wall systems defined by a plurality of upright space-dividing panels are widely utilized in offices and the like to divide large open areas into smaller workspaces. Such wall systems typically employ individual panels which are prefabricated and at least partially factory assembled. Such panels, which may be of floor-to-ceiling height or of lesser height, typically employ a rigid frame to which side cover pads are attached for enclosing the frame and defining the desired aesthetics of the finished wall panel. The cover pads, which may extend the full vertical height of the frame, or which may be a plurality of smaller pads which attach to the frame, typically include a sheetlike or platelike pad substrate which is exteriorly covered by a thin flexible covering sheet to provide for desired functionality with respect to aesthetics, acoustics and the like. Such covering sheet in some instances constitutes a thin flexible vinyl or foil-like material, but more frequently constitutes a thin fabric which is secured to the pad substrate so that the fabric defines the exterior side surface of the assembled wall panel. While constructions of this type are conventionally and widely utilized, the construction of such cover pads and specifically the application of a thin flexible covering sheet such as fabric to the support substrate has long been an undesirably inefficient and costly process requiring a high degree of manual labor and manipulation in order to ensure that the flexible covering sheet is properly attached to its underlying substrate in a manner which ensures proper alignment of the fabric while at the same time avoiding undesired looseness, puckering or wrinkling.

In the construction of upholstered pads or panels, as aforesaid, the substrate in one conventional construction is defined by a thin sheetlike facing pad which for example may be defined by a compressed mat of fiberglass, either with or without a supporting backer, and this facing pad in turn has a rigid ring-shaped rectangular frame fixed to the back side thereof. The frame extends along the peripheral edges of the pad and is contoured to accommodate clips or fasteners which mount the pad to the wall panel frame. This substrate is then covered by the covering sheet which extends across the front face of the facing pad and is manually wrapped around the side edges of the facing pad and frame so as to permit adhesive securement of the covering sheet edges to a rear side of the substrate, typically a rearwardly facing surface on the frame. As noted above, this is a time consuming and hence an expensive manual assembly process.

In an alternative construction of the upholstered pad or panel, a substrate can be defined by a relatively rigid platelike member, such as an MDF board, which board has the flexible covering sheet adhered either directly to the front face of the substrate or can have a thin compressible mat such as of fiberglass interposed therebetween, and the edges of the flexible covering sheet are manually wrapped around the edges of the substrate and adhesively secured to the back side thereof.

This type construction, which is used as a wall panel pad or as a tack board, also involves significant and costly manual assembly.

Accordingly, it is an object of this invention to provide an improved manufacturing apparatus and process which effects substantial automatic wrapping of the edges of a large, generally flat but thin, article such as a cover pad or panel, namely the wrapping of cover sheet flaps around the edges of a substrate and the adhesive securement of the cover sheet flaps to the edges and back side of the substrate, which apparatus and process results in formation of an upholstered article in a highly automated and efficient process which eliminates the significant manual manipulations and functions normally required.

More specifically, this invention relates to an apparatus which is capable of receiving and manipulating an article, herein referred to as a workpiece, defined by a substrate having a flexible cover sheet adhered to one large side (i.e. front) surface thereof, which cover sheet (for example fabric) is oversized relative to the substrate surface so that the cover sheet has flaps which project outwardly beyond at least side edge faces defined on opposite edges of the substrate. The substrate is preferably supplied to a positioning and sizing device which senses the width of the substrate and properly centrally positions it for feeding into a back wrapping apparatus. The back wrapping apparatus adjusts according to the width of the workpiece being supplied. When the workpiece is supplied to the back wrapping apparatus, the workpiece initially passes adjacent adhesive applicators which apply adhesive to the protruding cover sheet flaps. The workpiece is then fed into a back wrap station whereat roller assemblies disposed adjacent opposite sides of the workpiece are activated and effect movement of the flaps into adhesive and pressed contact with the respective side edge faces of the substrate. Rollers associated with the roller units then move inwardly so that the flaps are bent over and pressed into adhesive engagement with the back side of the substrate in close proximity to the respective side edge faces thereof. The roller units then return to an initial rest position, following which the workpiece is discharged from the back wrapping apparatus and a further operational cycle is initiated.

In a preferred arrangement according to the present invention, the workpiece typically has cover sheet flaps projecting outwardly beyond all four edge faces of a rectangular substrate, so that the workpiece can be fed through the back wrapping apparatus a second time to effect edge wrapping of the remaining pair of opposite side edge faces, or alternatively the workpiece can be fed through a second back wrapping apparatus which operates serially downstream of the first-mentioned back wrapping apparatus.

In the back wrapping apparatus of the present invention, the workpiece is preferably movably supported by a pair of sidewardly-spaced supports which extend lengthwise of the apparatus in the movement direction, and which are disposed uniformly on opposite sides of a lengthwise-extending centerline of the apparatus. The pair of supports mount thereon a pair of sidewardly-spaced but generally parallel conveyor belts having elongate upper belt reaches on which the workpiece is supported. The supports can be synchronously moved inwardly toward or outwardly away from one another to vary the spacing between the belts so as to conform the belt spacing to the width of the workpiece substrate being acted on. The belts move the workpiece initially past a pair of sidewardly-spaced adhesive applicators so that the flaps of the cover which protrude sidewardly from the substrate are sprayed with adhesive throughout the length thereof. Following the adhesive application, the belts move the workpiece into the back wrapping station whereat the belts are stopped to permit stoppage of the workpiece at a predefined location located between the back wrapping rollers. Back wrapping rollers are positioned sidewardly but outwardly adjacent the respective conveyor belts and extend lengthwise therealong and are supported for movement upwardly along and around the edge and respective upper corner of the substrate to effect pressing of the adhesively-coated cover flap into engagement with edge and back sides of the workpiece. The supports additionally have elongate clamp bars movably mounted thereon and individually positioned so that each clamp bar is disposed generally above and extends lengthwise along the respective upper reach of the conveyor belt. The clamp bars are vertically displaceable from a raised clearance position into a lower position for engagement with the substrate to hold it against the belt during upward movement of the wrapping rollers along the side edge faces of the substrate. The clamping bars are raised upwardly away from the workpiece when the rollers are moved inwardly to press the flaps into engagement with the back surface (i.e., the upwardly facing surface) of the substrate.

In the improved back wrapping apparatus, as aforesaid, there is additionally and preferably provided a third elongate conveyor belt disposed generally along the central longitudinal plane and which is moved synchronously with the conveyor belts associated with the sidewardly spaced supports. This third conveyor belt, at the upstream end, is preferably elongated so as to project outwardly to effect driving engagement with the workpiece, as it is fed into the back wrapping apparatus, prior to the workpiece engaging the drive belts associated with the side supports. The upstream projection of the center drive belt preferably overlaps the driving extent of additional drive belts associated with the infeeding and positioning device located upstream of the edge wrapping apparatus so as to provide a smooth and uniform transference of the workpiece from the infeeding apparatus to the edge wrapping apparatus.

This invention also relates to an improved process for effecting edge wrapping of an upholstered article such as a cover pad or panel, which process includes, in a preferred embodiment, many of the operational procedures carried out by the apparatus of this invention, as briefly summarized above, and as explained in greater detail hereinafter.

Other objects and purposes of the invention will be apparent to persons familiar with constructions and processes described herein upon reading the following specification and inspecting the accompanying drawings.

Figure 1:
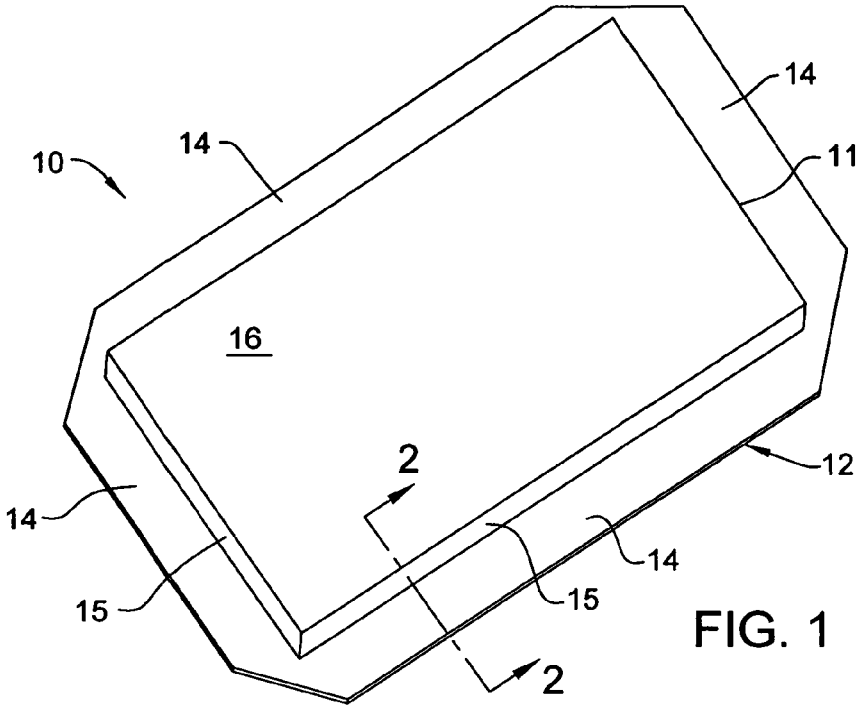
FIG. 1 is a perspective rear view illustrating a workpiece used for forming an upholstered article such as a pad or panel, which workpiece is defined by a substrate having a thin flexible cover sheet adhered to one large side surface of the substrate, with the cover sheet being oversized so that flaps of the cover sheet protrude outwardly beyond all four side edges of the substrate.

Certain terminology will be used in the following description for convenience in reference only, and will not be limiting. For example, the words "inwardly", and "outwardly" will refer to directions toward and away from the geometric center of the apparatus or of any designated part or component thereof. The word "forward" will refer to the normal direction of movement of the workpiece through the apparatus, which movement is from left to right in the arrangement illustrated by FIGS. 6-8, 11-12 and 20-21. The words "right" and "left" will be used to reference the sides of the apparatus, in the direction of movement thereof when viewed from the input end, namely, the leftward end in FIGS. 1-3. The words "upstream" and "downstream" will be used in reference to the direction of movement of the workpiece through the apparatus. The words "upwardly", "downwardly", "leftwardly" and "rightwardly" may also be used in conjunction with directions as appearing in the drawings. Said terminology shall be deemed to include the words specifically mentioned, derivatives thereof, and words of similar import.

DETAILED DESCRIPTION

In the following description, typical constructions of conventional workpieces are initially briefly described for background purposes, but it will be understood that other variations of such workpiece constructions can be adopted while still permitting their edge wrapping in accordance with the teachings of the present invention. A generalized description of the overall edge wrapping arrangement of the present invention will thereafter be presented, which description will be followed by detailed descriptions of the primary apparatus which are associated with the overall edge wrapping arrangement. This in turn will be followed by an overall description as to the operational process for carrying out the edge wrapping technique according to this invention.

Brief Description of Article

Figure 2:
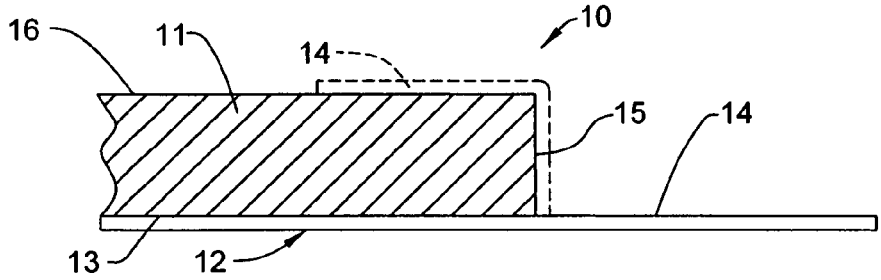
FIG. 2 is an enlarged, fragmentary cross sectional view taken generally along line 2-2 in FIG. 1, and also illustrating in dotted lines the flap of the cover sheet folded over and secured to the edge and back of the substrate.
Figure 3:
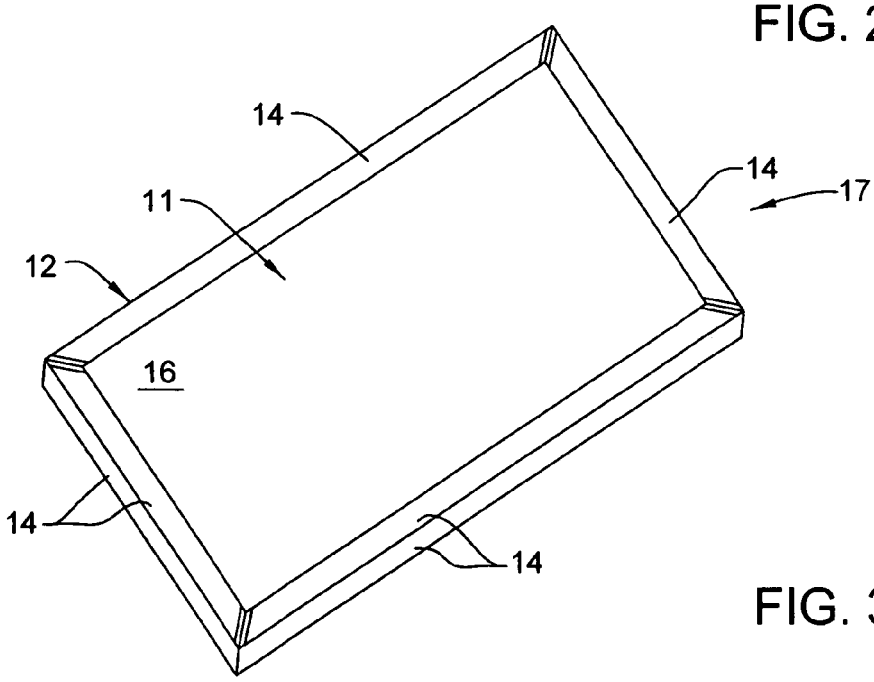
FIG. 3 is a perspective view corresponding generally to FIG. 2 but illustrating all of the covering sheet flaps folded over and adhered to the edges and back of the substrate.

Referring to FIGS. 1-3, there is illustrated one embodiment of a known article or workpiece 10 which is used for forming an upholstered article such as a pad or panel 17, and which can be utilized for permitting edge wrapping in accordance with the present invention.

The workpiece 10 illustrated by FIG. 1 includes a generally stiff or fairly rigid substrate 11 which has a sheetlike or platelike configuration defined by rather large front and back sides, with the substrate 11 having a thickness which is small in comparison to its other (i.e. length and width) dimensions. The substrate 11 has a flexible cover sheet 12 which totally overlaps and covers one side of the substrate 11, typically the front face. The size of the flexible cover sheet 12, which in many instances comprises a cloth or fabric or textile sheet, is greater than the size of the substrate 11 so that the cover sheet has edge portions or flaps 14 which protrude outwardly beyond all of the side edges or faces 15 of the substrate. As is typical, the corners of the cover sheet 12 are typically removed, one example being a diagonal cut removal as illustrated by FIG. 1, to reduce the amount of material at the corner so that, when the corner material is wrapped over the substrate, less wrinkling and puckering of material occurs. The flaps 14 of the cover sheet, as illustrated by FIG. 2, are intended to be wrapped around the edge faces of the substrate 11 so as to not only cover and be adhesively secured to the edge face 15, but also wrapped partially around the back side 16 so as to be adhesively engaged therewith. This latter condition is illustrated by FIG. 3 which shows the flaps 14 wrapped around and adhesively secured to the back surface 16, with the corners also being appropriately wrapped and tucked adjacent to the back side and secured in position, frequently by means of a staple or other suitable structure. When so wrapped, the upholstered pad 17 can then be used in a conventional manner, such as a tack board or as a wall pad for attachment to a wall panel frame. Appropriate fasteners, in a conventional manner, can be attached to the back side of the pad.

Figure 5:
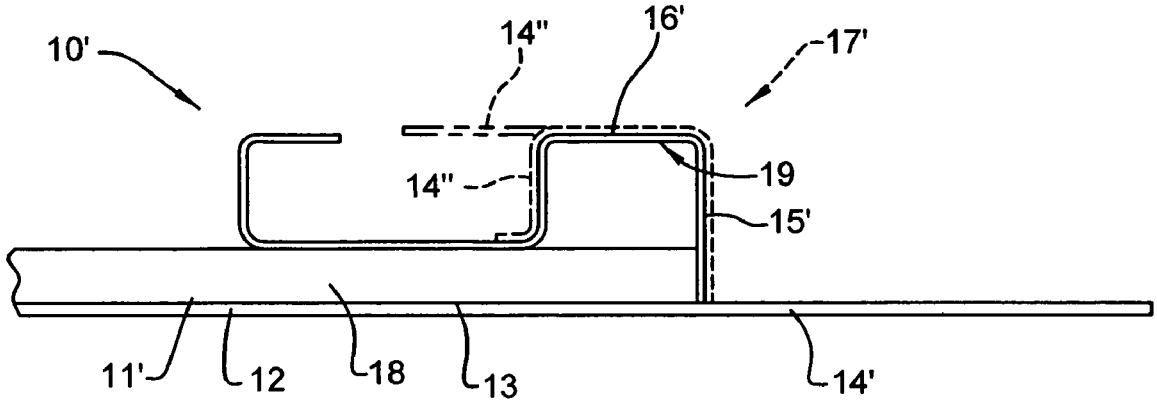
FIG. 5 is an enlarged fragmentary cross sectional view taken generally along line 5-5 in FIG. 4, and additionally showing in dotted lines the cover sheet flap folded upwardly and over for adhesive securement to the side face and back of the substrate.
Figure 4:
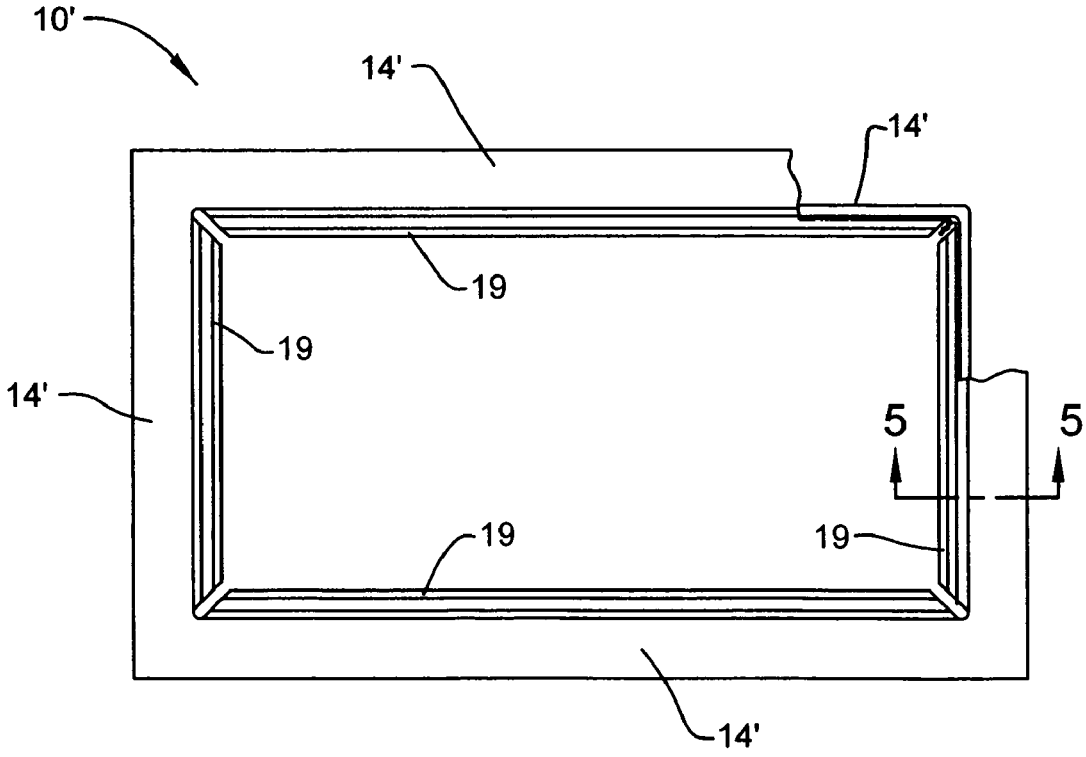
FIG. 4 is a plan view showing the back side of a modified workpiece wherein the flexible cover sheet is larger than and protrudes outwardly beyond the edges of the substrate, with the substrate including a rigid rectangular frame secured to the back thereof and positioned adjacent the peripheral edges thereof.

Referring now to FIGS. 4 and 5, there is illustrated another known configuration of a workpiece 10' which is used for creating an upholstered pad or panel. In this variation the substrate 11' is defined by a facing pad 18, such as a thin pad which may be formed of a compressed fiberglass mat or other material, and which may have a thin backing sheet (not shown) provided thereon. The substrate 11' also includes a ring-shaped frame defined by a plurality of elongate rails or brackets 19 fixed to the rear of the pad 18 and positioned adjacent and extending lengthwise along each of the perimeter edges thereof. The frame rails 19 are typically constructed of metal or other relatively rigid material, and have a cross sectional configuration which enables them to accommodate clips or fasteners so that the resulting finished pad 17' can be attached to a wall panel frame. In this construction, the flaps 14 of the cover sheet again wrap upwardly and adhesively secure not only to the outer side face 15', but also wrap around and secure to a back side surface 16' as defined on the respective edge rail 19. Depending on the size of the flap 14, there may exist a flap portion 14' which extends beyond the rail surface 16', and this flap portion 14' can be deflected downwardly so as to adhesively engage an inner surface of the edge rail as illustrated by FIG. 5.

It will be understood that, with respect to the edge wrapping arrangement as described hereinafter, such arrangement permits edge wrapping of a wide variety of articles including pad constructions having features similar to those illustrated by FIGS. 1-5.

Edge Wrapping Arrangement

Referring to FIGS. 6-9, there is illustrated an overall edge wrapping arrangement 21 according to the present invention. This edge wrapping arrangement 21 can cooperate with an article, such as a workpiece 10 or 10' described above, to permit the protruding cover (e.g. fabric) flaps 14 associated with an opposite pair of side edges to be wrapped around the respective edge faces and adhesively secured to at least the back side of the substrate in close proximity to the respective edge face.

The upstream end of the edge wrapping arrangement 21 is defined by a workpiece infeeding apparatus 22 which is sequentially supplied with individual workpieces 10 and which automatically feeds the workpiece into a positioning station which automatically effects proper centering of the workpiece so that it is properly aligned for discharge, and which also effects sensing of the size of the workpiece so as to permit the subsequent stage of the apparatus 21 to properly adjust its width in conformance with the size of the incoming workpiece.

The overall edge wrapping arrangement 21 additionally includes an edge wrapping apparatus 23 positioned directly downstream of the infeeding apparatus 22 for sequentially receiving the workpieces as they are discharged from the infeeding apparatus. This edge wrapping apparatus 23 permits wrapping of a pair of opposed fabric flaps 14 as the workpiece 10 is moved lengthwise through the apparatus. For this purpose, the edge wrapping apparatus 23 includes a supporting and advancing structure 27 which extends lengthwise of the apparatus and both supports and advances the workpiece as it is moved through the apparatus from the input to the discharge end thereof. This workpiece support and advancing structure 27 is also adjustable in width, based on workpiece size as sensed at the infeeding apparatus, so as to adjust to the width of the workpiece being supplied. The workpiece supporting and advancing arrangement also provides, adjacent the upstream end thereof, adhesive applying stations 28 which effect application of an adhesive, such as a spray-on hot melt, onto the sidewardly protruding flaps 14 of the cover as the workpiece moves into the apparatus 23 and is moved toward an edge wrapping position wherein the leading edge of the workpiece is disposed more closely adjacent the discharge end. There is additionally provided a pair of wrapping mechanisms which are positioned adjacent opposite sides of the apparatus and which each includes a horizontally elongate edge wrapping roller which is positioned adjacent and extends throughout one side edge of the workpiece when it is located at the edge wrapping station. The roller, as explained hereinafter, is activated so as to roll upwardly along the edge and over the upper corner so that the respective cover flap, which has already had adhesive applied thereto, is pressed upwardly against the side edge of the substrate and is then wrapped over for adhesive engagement with the back side of the substrate.

The workpiece, after the cover flaps associated with opposite side edges have been adhesively secured to the substrate, is then discharged longitudinally from the edge wrapping apparatus 23 to a discharge or workpiece transfer station 26, from which the workpiece can then be subsequently handled as desired.

Infeeding Apparatus

Referring to FIGS. 10-14, the infeeding apparatus 22 sequentially received individual workpieces 10 and feeds them to the discharge end thereof whereat a positioning structure 26 effects stoppage of the workpiece and also effects sideward displacement of the workpiece as necessary so that the workpiece is longitudinally centrally aligned. This sideward centering of the workpiece also senses the width of the workpiece, all as explained below.

Figure 6:
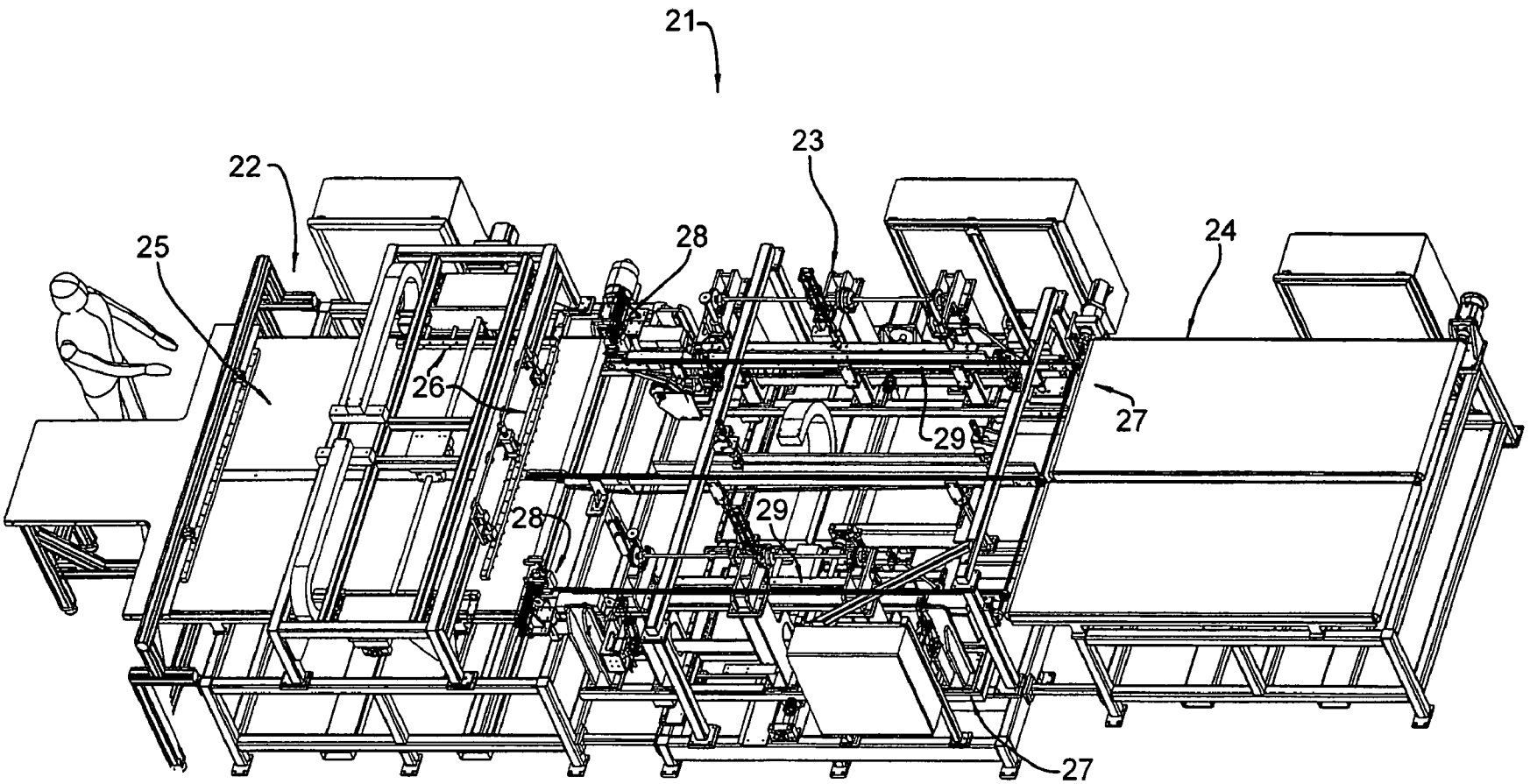
FIG. 6 is a perspective view of an arrangement for acting on a workpiece, such as workpieces illustrated by FIGS. 1-5, for acting on and effecting wrapping of an opposed pair of substrate edge faces.
Figure 10:
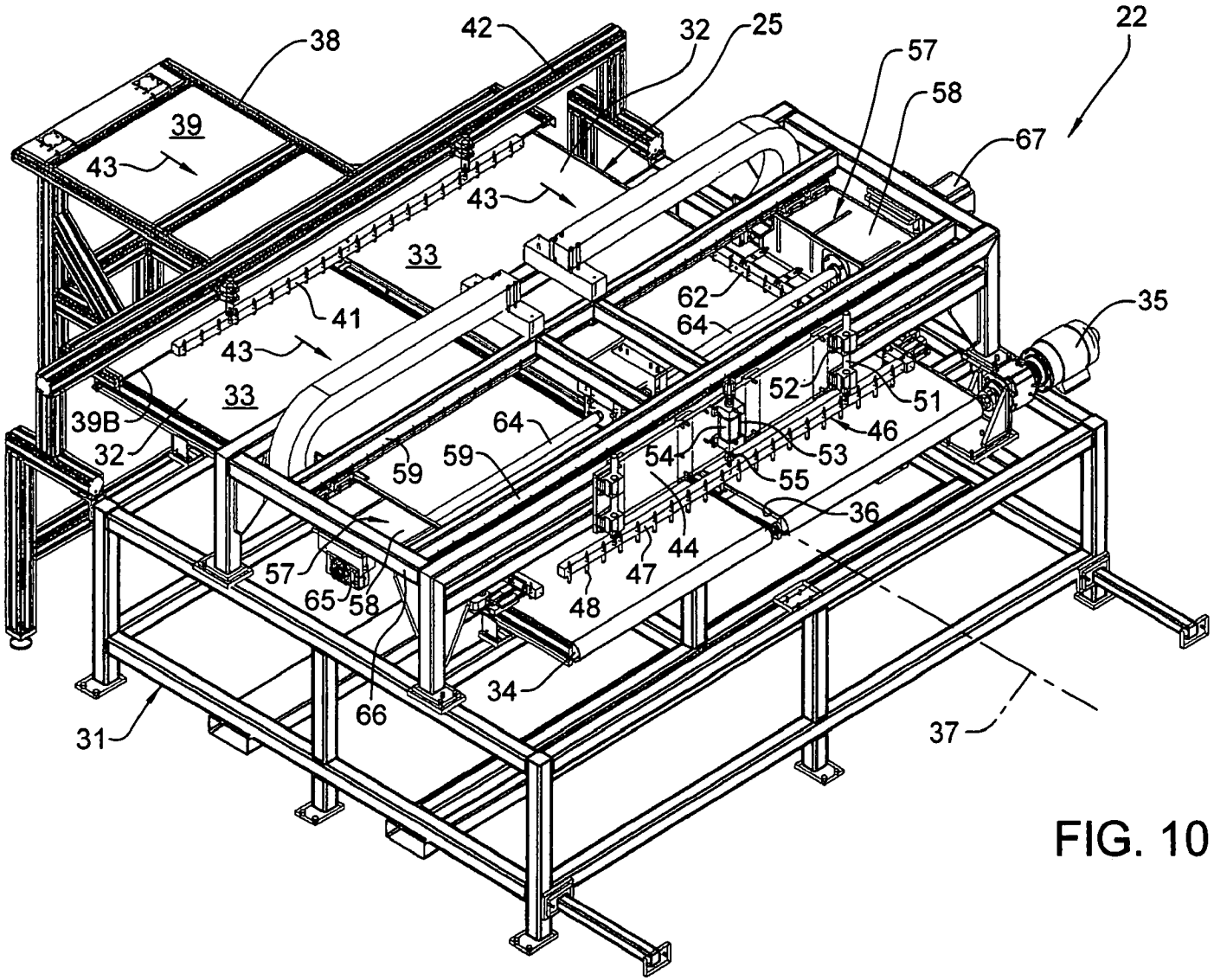
FIG. 10 is a perspective view, taken generally from the right front (i.e., downstream) corner, of a workpiece infeeding apparatus, which apparatus positions and senses the size of the workpiece, and effects feeding thereof into the next stage of the overall arrangement.
Figure 11:
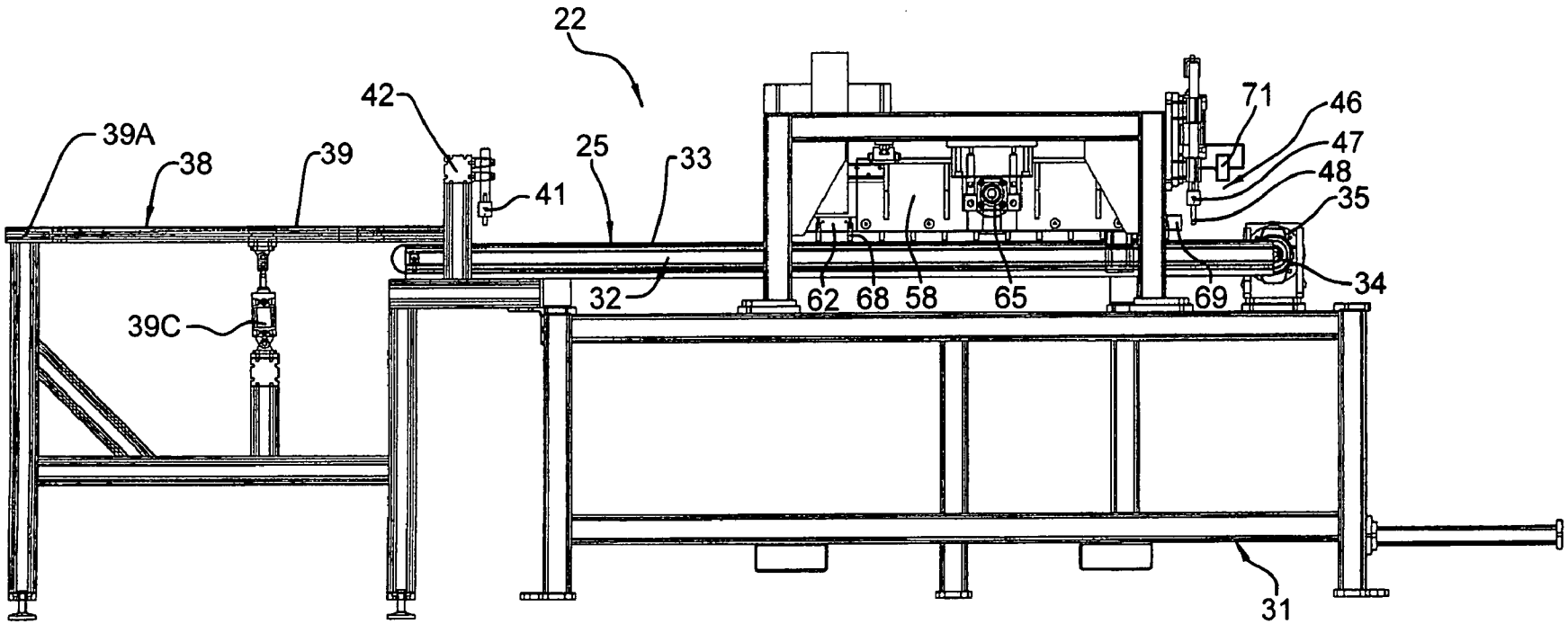
FIG. 11 is a right side elevational view of the infeeding apparatus illustrated by FIG. 10.
Figure 12:
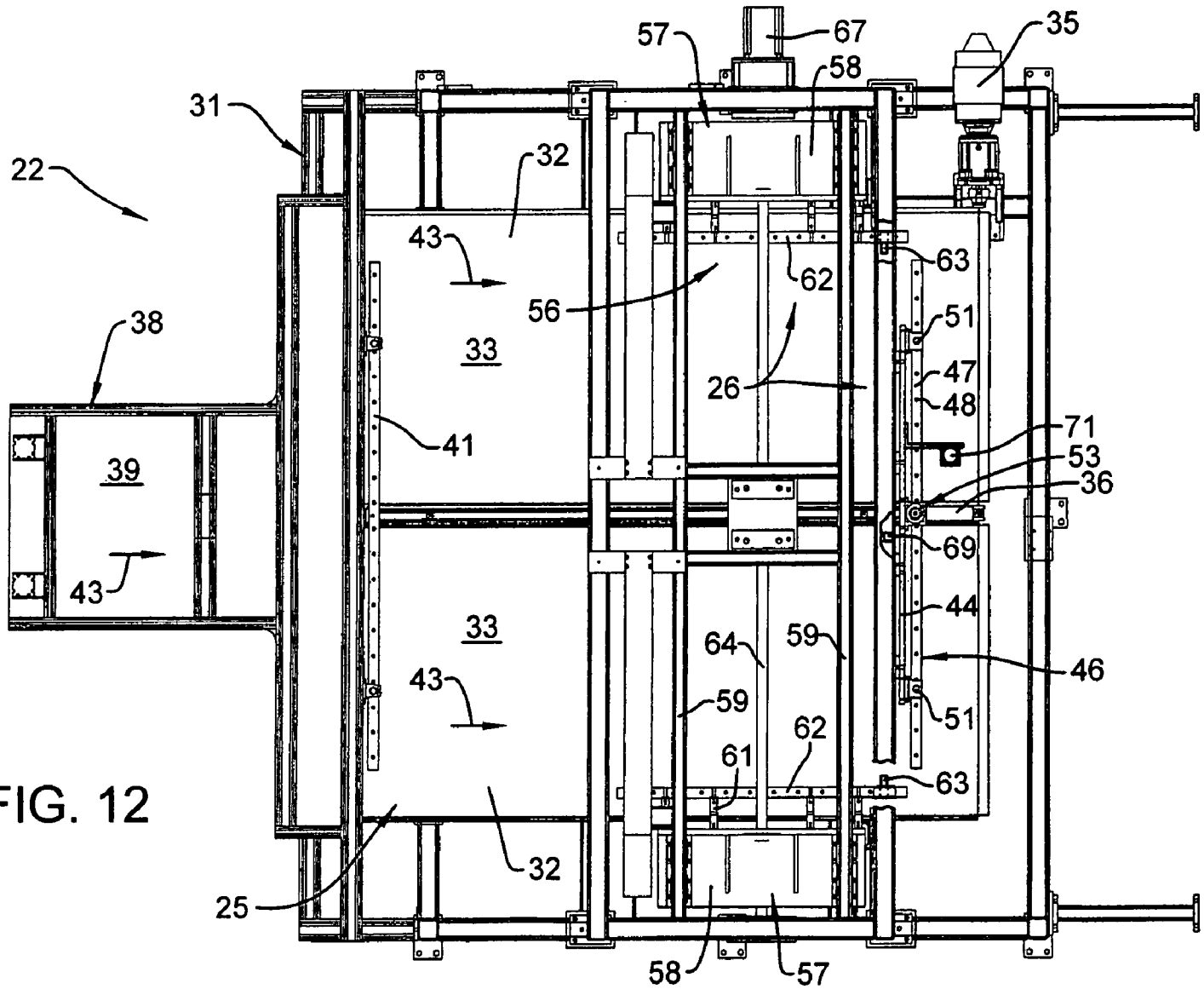
FIG. 12 is a top view of the infeeding apparatus.
Figure 13:
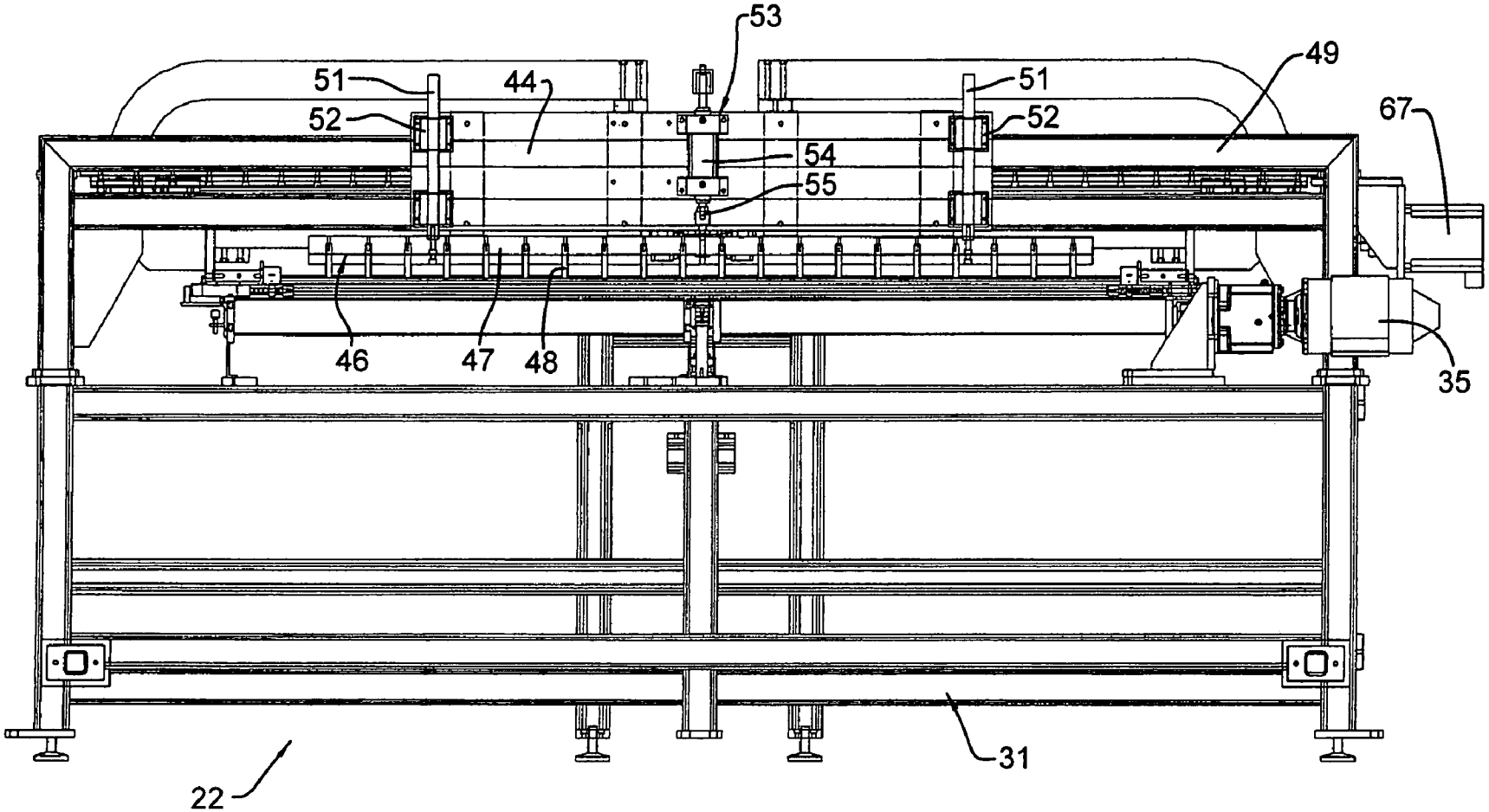
FIG. 13 is an end elevational view of the infeeding apparatus taken from the discharge end (the rightward end in FIG. 11) thereof.
Figure 14:
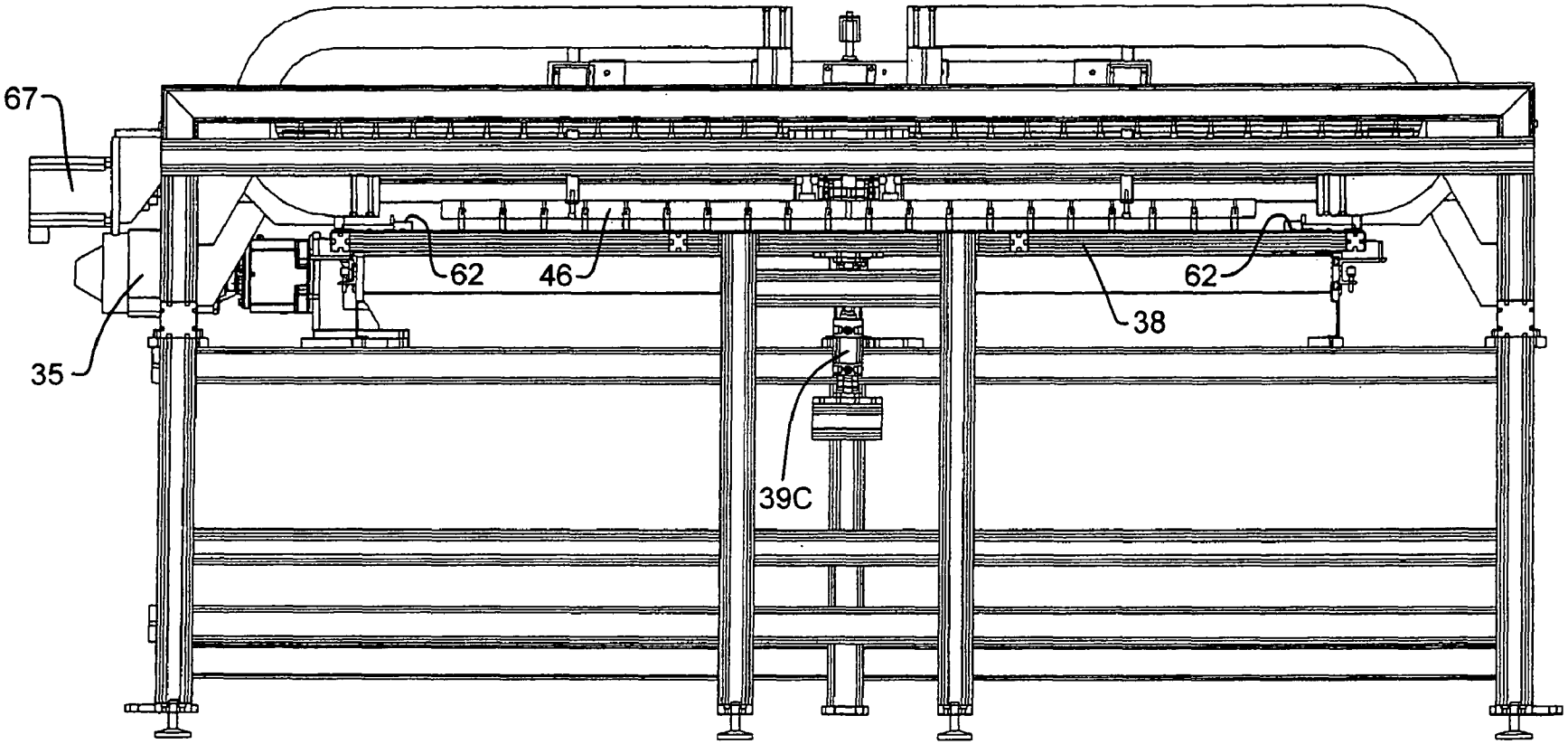
FIG. 14 is an end elevational view taken from the upstream end (the leftward end in FIG. 11) of the infeeding apparatus.
Figure 15:
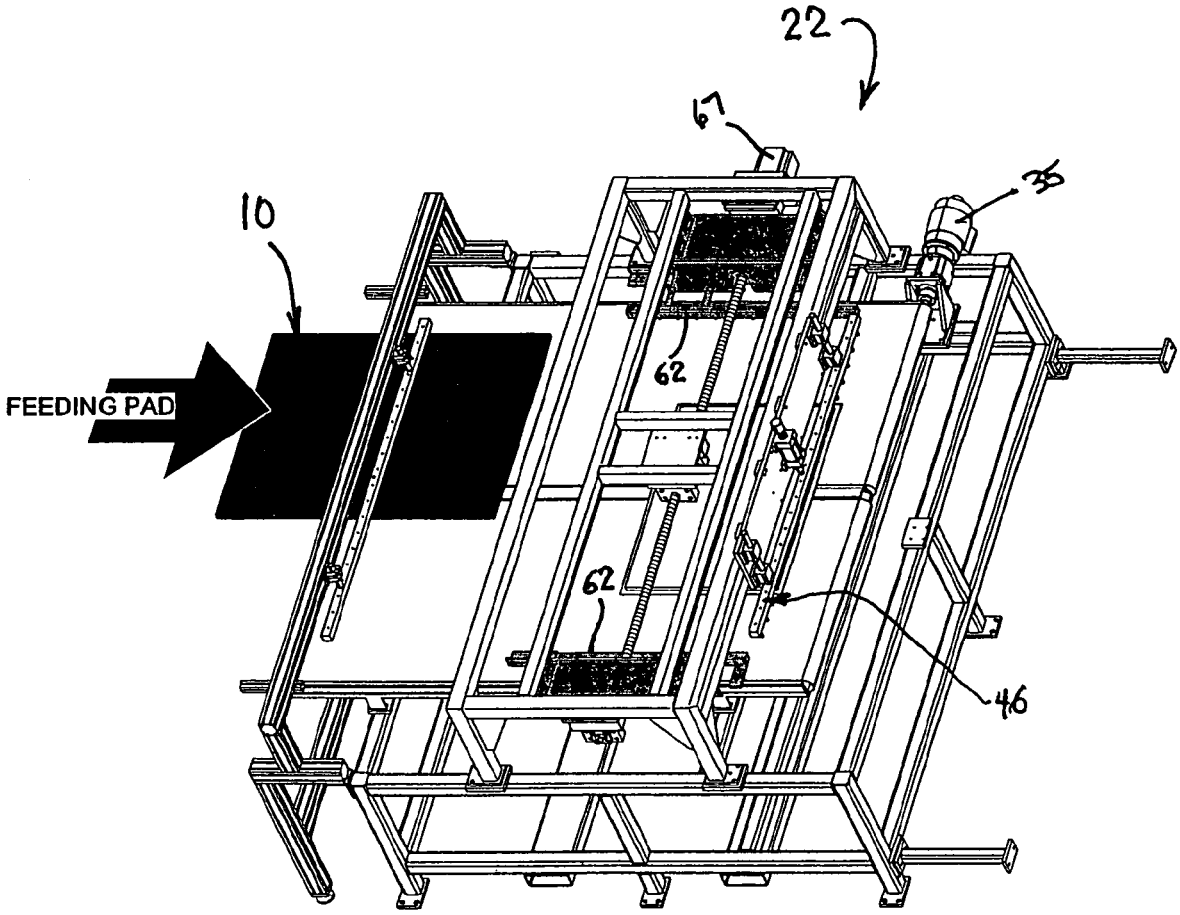
FIGS. 15 and 16 are perspective views of the infeeding apparatus similar to FIG. 10, and which diagrammatically illustrate the manner in which the apparatus cooperates with a workpiece.

The infeeding apparatus 22, as best illustrated by FIGS. 10 and 12, includes a workpiece advancing structure 25 which includes two (i.e. right and left) conveyor belts 32 which are flat wide belts having upper belt reaches 33 which are oriented generally horizontally so that the belts extend between upstream and downstream support rollers. The downstream support roller 34 functions as the driving roller for the belts, and its drive shaft is connected to a suitable drive motor 35 which effects synchronous driving and stopping of the belts 32 in accordance with signals received from a suitable controller which can be housed in one of the many control panels associated with the apparatus, which control panels are illustrated in FIG. 6 but are deleted from most other figures for clarity of illustration.

As illustrated by FIGS. 10 and 12, the two conveyor belts 32 are positioned in sidewardly adjacent relationship but are spaced sidewardly a small distance apart so as to define a small gap 36 therebetween. This latter gap is provided to accommodate therein a center drive belt associated with the edge wrapping apparatus 23 located downstream, as explained hereinafter. This gap 36, which extends lengthwise of the apparatus between the sidewardly adjacent conveyor belts 32, extends generally along the longitudinally extending centerline 37 of the infeeding apparatus.

To control the sequential supply of workpieces into the infeeding apparatus 22, there is provided a feeding table 38 which defines thereon a large upper surface 39 adapted to have an inverted workpiece 10 positioned thereon, that is, the workpiece 10 is positioned so that the fabric or cover sheet 12 faces downwardly and directly engages the upper surface 39. This upper surface 39 is normally disposed at an elevation slightly above the upper surface 33 defined by the conveyor belts 32, and the table 38 adjacent its rearward edge is supported about a horizontal hinge 39A so that the leading free edge 39B of the table, which is positioned generally over the upper belt reaches 33 in the vicinity of the upstream ends thereof, can be moved downwardly into a position which closely engages the upper surfaces of the conveyor belts 32. This downward swinging displacement of the table 38 can be automatically controlled by a suitable activating device 39C, such as a pressure cylinder. The forward movement of a workpiece from the table 38 onto the conveyor belts 33 is normally prevented by a control stop or gate 41 when the table 38 is in its raised horizontal position. In this latter position, the gate 41, which is supported in downwardly spaced relationship from a frame cross beam 42, is disposed at an elevation which prevents the workpiece from being slidably moved forwardly from the work table 38. However, the control gate 41 is spaced forwardly from the front edge 39B of the table by a sufficient distance so as to prevent the front cover flap 14 from being trapped between the workpiece and the table top surface 39, thereby ensuring that the front flap 14 on the workpiece will hang downwardly when the workpiece is moved forwardly so that the substrate 11 abuts the stop 41. When so positioned, downward swinging of the table 38 about the horizontal hinge 39A enables the front edge 39B to move downwardly to a position adjacent the upper belt reach 33, thereby enabling the workpiece to move forwardly beneath the stop 41 and hence move into engagement with the moving conveyor belts 32. As the downwardly hanging front cover flap initially engages the moving conveyor belts, this causes the front flap to be moved forwardly and hence ensures that the front flap properly projects outwardly away from the substrate as the workpiece is moved onto the conveyor belts. The movement of the workpiece from the downwardly tilted table onto the moving conveyor belts can be controlled either manually or by a suitable automated advancing structure (not shown).

The workpiece when engaged with the moving conveyor belts 32 is then moved forwardly in the direction indicated by the arrows 43, which continues so as to advance the workpiece into engagement with a stop bar 46, the latter being normally maintained in a lowered position so that downwardly cantilevered pins 47 carried thereon will contact the substrate 11 of the workpiece. The downwardly cantilevered pins 47, however, are normally spaced upwardly a small distance above the conveyor belts so as to provide a small clearance gap which enables the forwardly projecting front cover flap 14 to pass through this gap and hence not bunch up against the stop bar. If the workpiece is angularly displaced when the substrate initially contacts the stop bar 46, the driving of the motor 35 and hence the driving of the conveyor belts 32 will continue, thereby causing the workpiece to longitudinally align against the stop bar, which longitudinal alignment will be sensed by a sensor 69 which is stationarily mounted above the conveyor belts directly adjacent the upstream side of the front stop gate 46. When sensor 69 senses that the substrate of the workpiece is closely adjacent and hence substantially abutting the stop gate 46, the sensor 69 sends a signal which stops the drive motor 35, thereby preventing the conveyor belts from running and hence rubbing against the exposed face of the cover sheet or fabric.

The sensor 69 may comprise a conventional ultrasonic position sensor which is able to determine not only the presence of the front edge of the workpiece substrate when positioned adjacent the front gate 46, but is also able to determine the thickness of the substrate which, by appropriate software associated with the controller, can hence determine the type of workpiece being supplied to the back wrapping arrangement so as to control any of the height-sensitive moving parts of the back wrapping apparatus 23.

To ensure that the workpiece is properly centrally (i.e. sidewardly) positioned along the longitudinal centerline 37 when disposed in abutting engagement with the control gate 46, the positioning structure 26 associated with the infeeding apparatus 22 includes not only the control gate 46, but also includes a centering and sizing arrangement 56 which, as illustrated by FIG. 12, includes right and left side guides 57 symmetrically positioned on opposite sides of the longitudinal centerline 37 and positioned just rearwardly (i.e. upstream) of the control gate 46.

Each side guide 57 includes a moveable support 58 which is suspended from and movably supported on a pair of generally parallel top beams 59 which are fixed to and extend perpendicularly between side frame beams, with the support 58 being slidably moveable lengthwise of the beams generally perpendicular with respect to the longitudinal or workpiece movement direction, whereby the supports 58 can hence be moved inwardly toward or outwardly away from the longitudinal centerline 37. Each moveable side support 58 mounts thereon a plurality of outwardly protruding support arms 61 which, at their outer ends, support an elongate guide member 62, the latter being horizontally elongated generally parallel with the longitudinal centerline 37, and hence being elongated in the normal direction of movement. Each of these guide members 62 has a plurality of sidewardly spaced contact pins 68 protruding downwardly therefrom, which pins are spaced upwardly a small distance from the upper surface of the conveyor belts 32. These pins 68 function similar to the pins associated with the control bar 46. That is, the pins 68 on the side guides 62 can move inwardly so as to contact a side surface of the substrate associated with a workpiece, whereas the small clearance below the pins 68 enables the side cover flap 14 to protrude sidewardly under the pins and hence lay flat on the conveyor belts.

Each of the elongate guide members 62, adjacent the front or downstream end thereof, has a contact sensor 63 provided thereon for sensing when the guide member is moving into contact with the side edge of the workpiece substrate. The contact 63 may assume many different forms but, in a preferred embodiment, comprises a linear variable differential transformer (LVDT) which, when it initially moves into contact with the workpiece substrate, is progressively depressed and effects progressive slowing of the inwardly moving guide member 62 until such time as the guide member effectively fully contacts the side of the workpiece substrate, whereupon the inward movement is stopped so as to prevent damage to the substrate.

The guide members 62 associated with the side guides can be transversely and simultaneously moved inwardly toward the centerline 37 so as to effect initial contact with at least one side of the workpiece substrate, whereupon the workpiece substrate is then shifted sidewardly and the inward movement of the side guides continues until both side guides come into contact with opposite sides of the substrate. To accomplish this movement, an elongate rotatable drive shaft 64 extends transversely across the conveyor belts in upwardly spaced relationship at a location spaced rearwardly from the front control gate 46. This drive shaft 64, adjacent the ends thereof, is rotatably supported in appropriate bearings 65 as mounted on frame elements 66. One end of the drive shaft 64 protrudes outwardly and is coupled to a suitable drive motor, specifically a servomotor 67 which can effect variable speed driving of the shaft 64, particularly when one or both of the contact sensors 63 is being depressed due to contact with the workpiece substrate. The drive shaft 64 is, adjacent opposite ends, drivingly coupled to the moveable supports 58, such as through screw or ball-screw arrangements of opposite hand so that, upon rotation of the shaft in one direction, the opposed supports 58 simultaneously move inwardly, and upon rotation of the shaft 64 in the opposite direction the opposed supports 58 simultaneously move outwardly.

The front control gate or stop 46 is movably supported from a top cross beam 49 which extends transversely and is part of the frame. The movement of the control gate 46 is vertically slidably guided by a pair of generally parallel guide rods 51 which are fixed to the bar 47 adjacent opposite ends thereof, and which project vertically upwardly in generally parallel relationship. Each of the guide rods 51 in turn is slidably guided within suitable bushings 52 which are fixed to a vertical mounting plate 44 which is fixed to the frame and extends transversely in raised relationship relative to the conveyor belts. A vertical drive 53 is coupled between the stationary guide plate 44 and the control bar 46, which drive 53 in the illustrated embodiment comprises a double-acting pressure cylinder whose housing 54 is fixedly mounted on the plate 44, and whose piston rod 55 projects downwardly and is coupled to the control gate 46. This pressure cylinder 53 hence effects controlled movement of the control gate 46 between a lowered position wherein the stop pins 48 thereof are positioned a small distance above the conveyor belts so as to effect stoppage of workpieces, and a raised position wherein the stop pins 48 are raised to a sufficient height permitting workpieces to pass thereunder for feeding to the edge wrapping apparatus 22.

Edge Wrapping Apparatus

The structure of the edge wrapping apparatus 23, and the operational functions associated therewith, will now be described, principally in conjunction with the apparatus illustrated by FIGS. 17-28.

Figure 17:
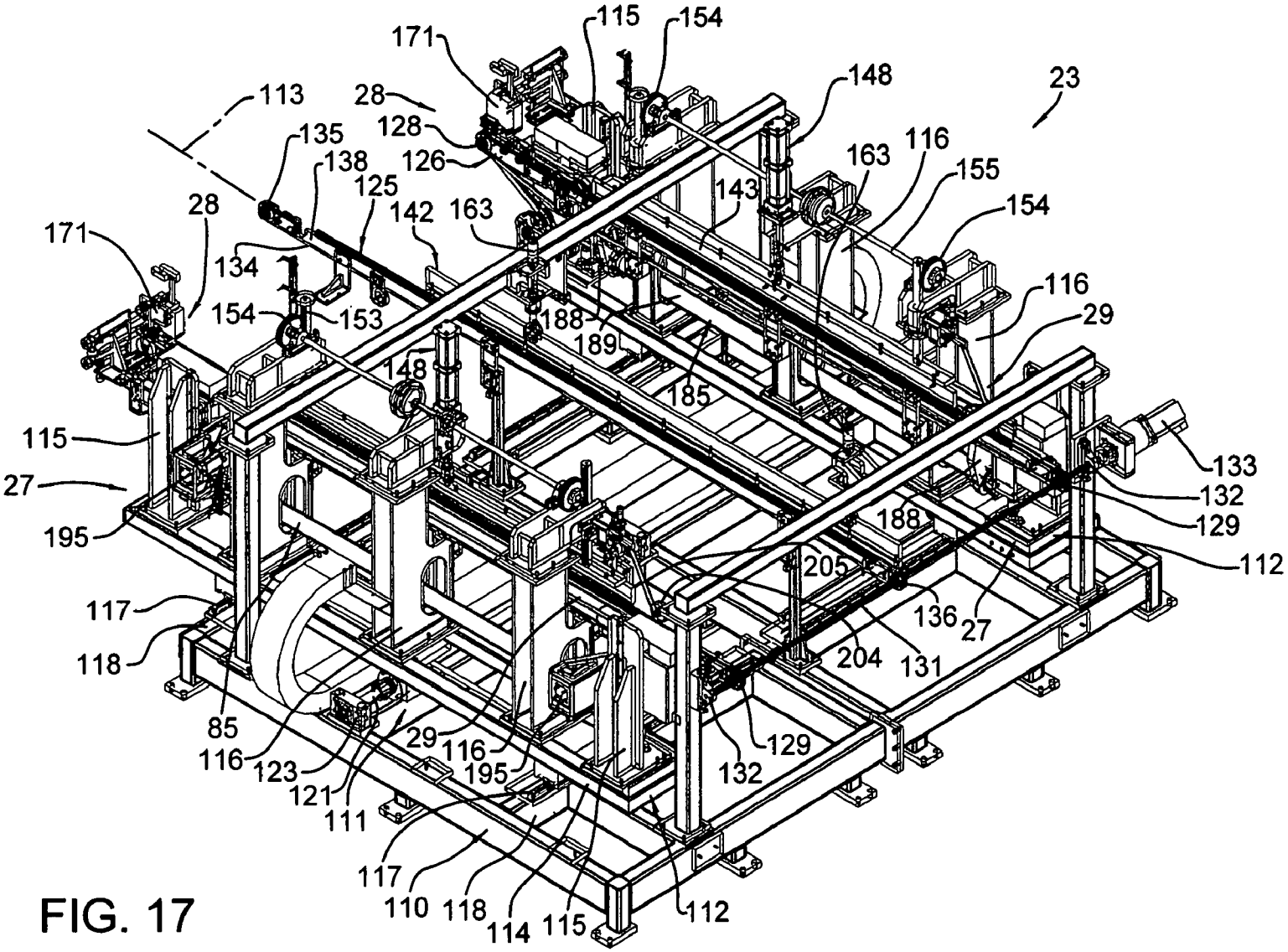
FIG. 17 is a perspective view taken generally from the right front (downstream) corner and showing a two-side edge wrapping apparatus, the latter being positioned directly downstream of the infeeding apparatus of FIG. 10.
Figure 18:
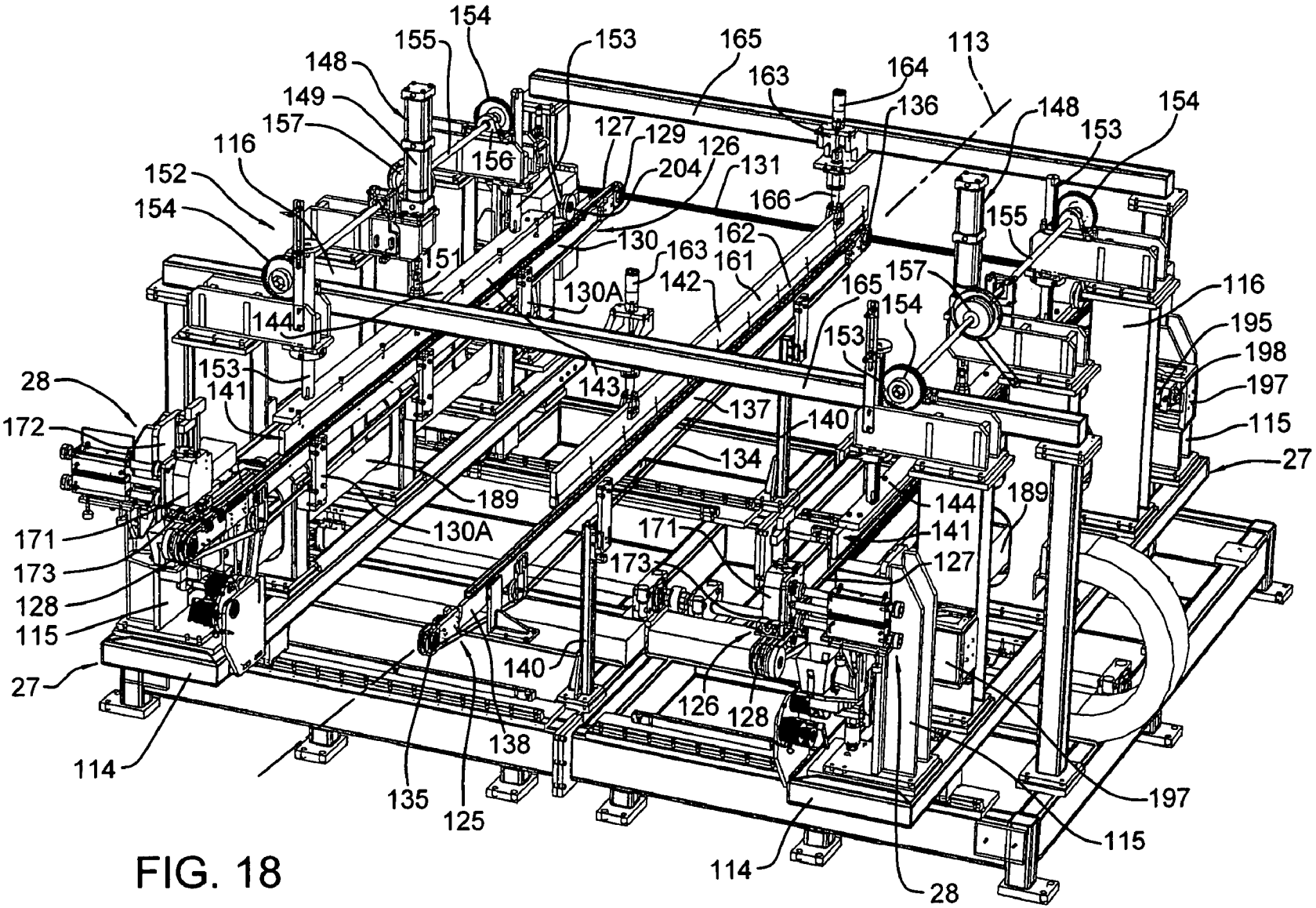
FIG. 18 is a further perspective view of the edge wrapping apparatus, similar to FIG. 17, taken generally from the right rear (i.e. upstream) corner thereof.
Figure 19:
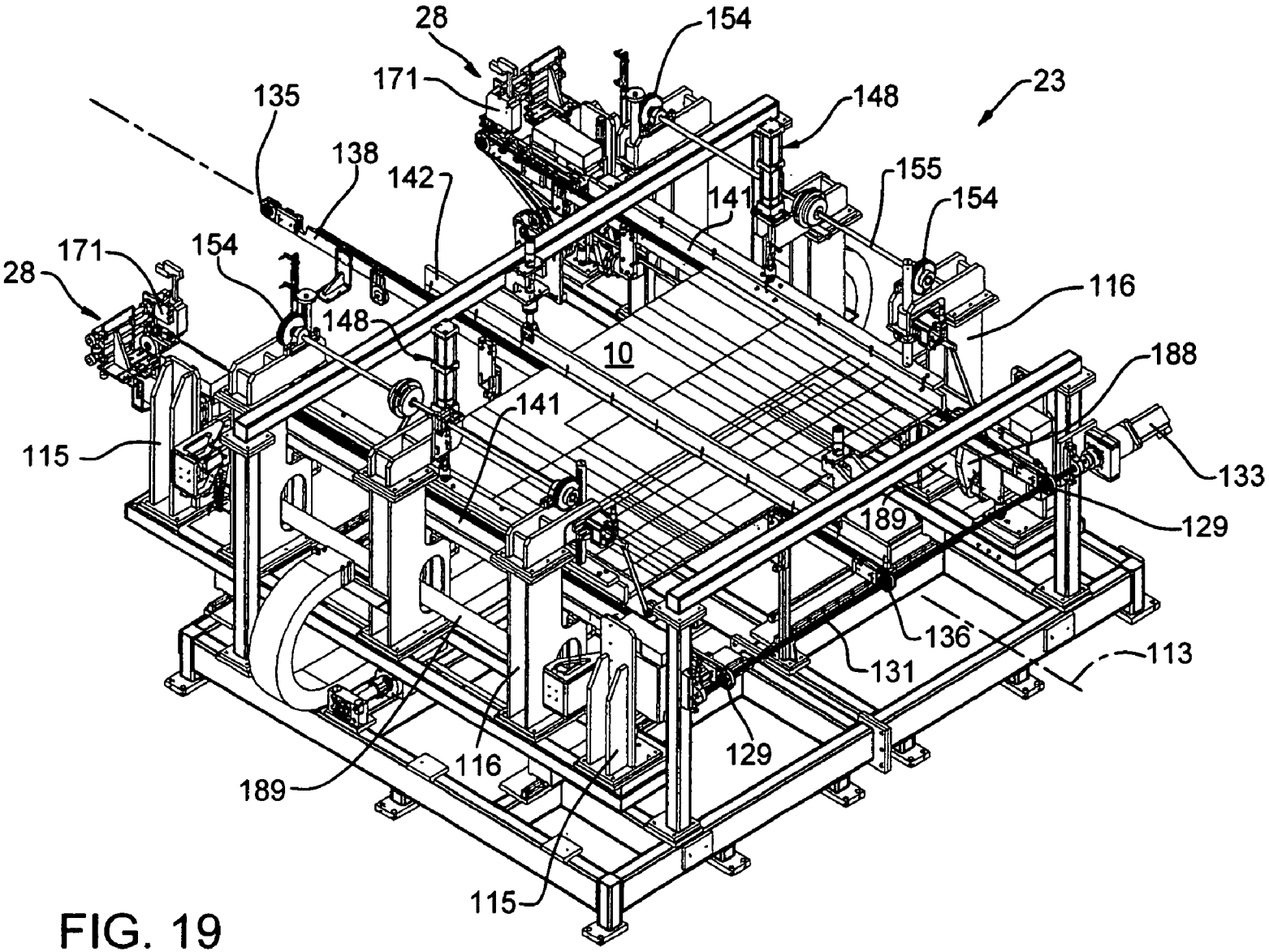
FIG. 19 is a perspective view which corresponds to FIG. 17 but which illustrates the edge wrapping apparatus having a workpiece supported thereon at the edge wrapping position.

Referring specifically to the edge wrapping apparatus 23 as illustrated in FIGS. 17 and 18, this apparatus includes a frame 110 which supports a width adjusting structure 111 which includes a pair of movable side supports 112, specifically right and left side supports which are symmetrically positioned on opposite sides of the longitudinally extending centerline 113. The movable side supports 112 are elongated generally parallel to this centerline 113.

Each side support 112 includes a base plate 114 which is horizontally elongated in the lengthwise direction of the apparatus. This base plate 114 in turn rigidly mounts thereon a pair of uprights 115 which are disposed adjacent opposite ends of the base plate, and a plurality of intermediate uprights 116 which are disposed in spaced relationship between the end uprights 115.

The sidewardly disposed pair of side supports 112 are horizontally movably supported on a pair of parallel guide rails 117 which extend transversely (i.e. perpendicularly) with respect to the centerline 113, and the guide rails 117 in turn are mounted on transverse cross beams 118 which are a fixed part of the frame. The rails 117 movably support the right and left side supports 112 for movement toward and away from one another, and hence toward and away from the longitudinal centerline 113. To effect this latter movement, a cross drive shaft 121 extends transversely across the bottom of the frame at a location between the front and rear guide rails 117, and this drive shaft at one end is coupled to a suitable drive motor 122 (FIG. 21), the other end of the drive shaft being rotatably supported in a suitable bearing 123. The drive shaft 121 is drivingly interconnected to a suitable mechanism, such as gears and racks, which connects to the side support bases 114 so as to effect synchronous movement of the right and left supports 112 either toward or away from one another.

The pair of movable side supports 112 support thereon a pair of horizontally-elongated drive belt arrangements 126 (FIG. 18), namely right and left such belt arrangements 126 respectively associated with the right and left movable supports 112. The drive belt arrangements 126 are substantially identical and are symmetrically disposed on opposite sides of and are elongated generally parallel with the longitudinal centerline 113. Each drive belt arrangement 126 includes an elongate endless drive belt 127 which is supported on and extends generally horizontally between upstream and downstream belt-support pulleys 128 and 129, respectively. These pulleys maintain the upper reach of the drive belt 127 in a generally horizontally elongated disposition, with the upper reaches of the sidewardly-spaced belt arrangements 126 effectively defining a horizontally-oriented support plane for supporting a workpiece thereon.

The drive belt arrangement 126 includes an upright support plate 130 which is elongated horizontally in the lengthwise extent of the apparatus, and is rigidly carried on the respective side support 112 by a plurality of support arms 130A. The support plate 130 has a horizontally elongate upper edge which acts as a slidable support for the upper reach of the respective drive belt 127, and the upstream and downstream ends of this support plate respectively rotatably mount thereon the upstream and downstream pulleys 128 and 129. This construction enables the respective drive belt arrangement 126 to be carried on and hence sidewardly displaced when the respective side support 112 is moved, thereby enabling the sideward horizontal spacing (i.e. width) between the pair of drive belt arrangements 126 to be varied so as to be compatible with the width of the workpiece supported thereon.

To effect simultaneous driving of the drive belts 127, the downstream belt support pulleys 129 are non-rotatably but axially slidably supported on an elongate drive shaft 131 which extends transversely across the apparatus adjacent the downstream end thereof. This drive shaft 131 is rotatably supported from the frame by appropriate bearings 132 (FIG. 17), and a suitable drive motor 133 is coupled to one end of the shaft 131 to effect rotation thereof, and hence effect simultaneous movement of the drive belts 127.

The edge wrapping apparatus 23 also includes a center drive belt arrangement 125 which, while it operates synchronously with the drive belt arrangements 126, it is not transversely or sidewardly movable. Rather, this center drive belt arrangement 125 is disposed parallel with and generally midway between the side drive belt arrangements 126, and in fact the center drive belt arrangement 125 extends generally along the longitudinal centerline 113. The center drive belt arrangement 125 also includes a horizontally elongate endless drive belt 134 which extends between upstream and downstream support pulleys 135 and 136, with the downstream or front pulley 136 being non-rotatably engaged with an hence driven by the front drive shaft 131. The pulleys 135-136 support the drive belt 134 such that the horizontally elongated upright reach thereof is parallel and generally horizontally coplanar with the upper belt reaches defined by the side drive belts 127, and hence additionally defines the horizontal support plane for a workpiece.

Figure 7:
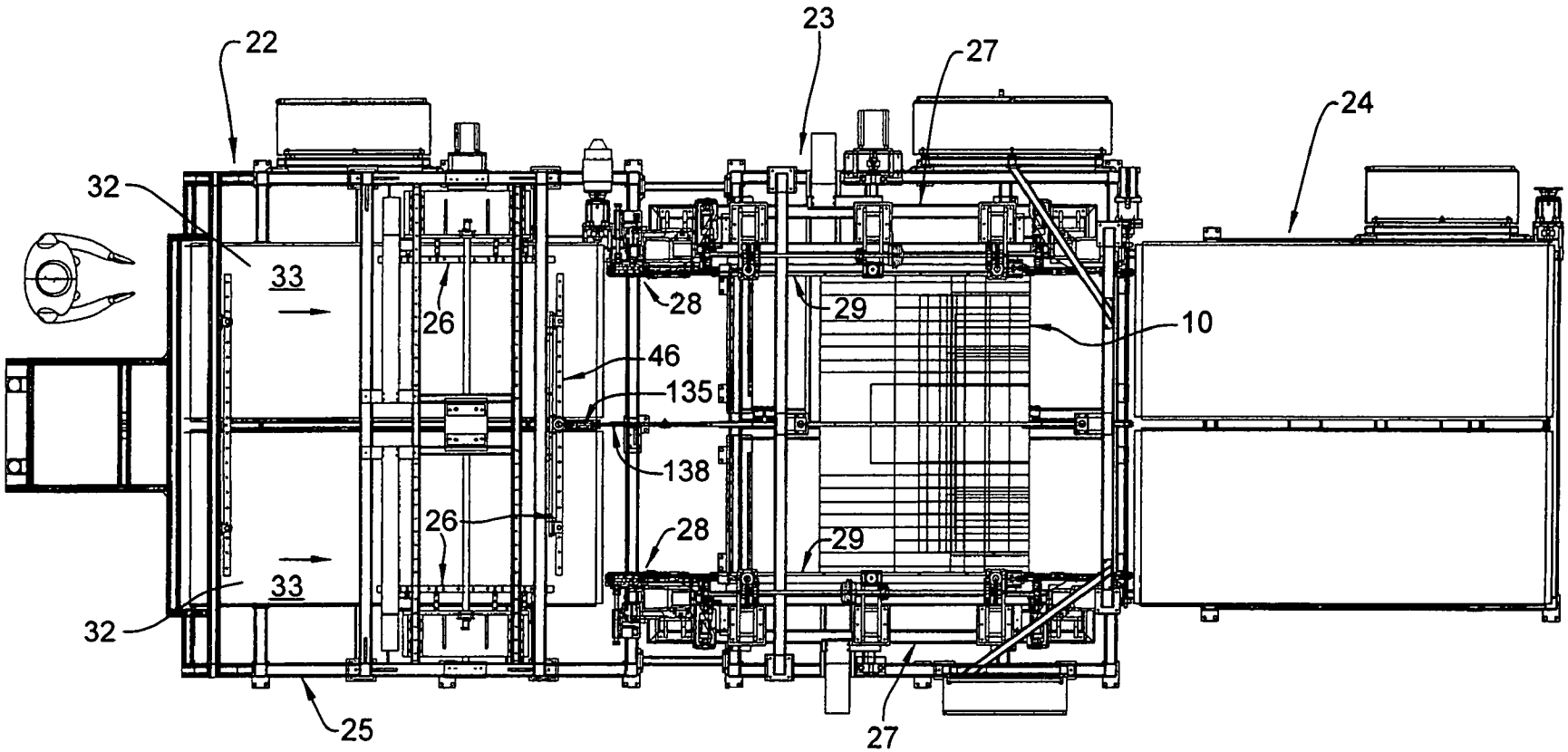
FIG. 7 is a top view of the arrangement illustrated in FIG. 6, and illustrates a workpiece disposed at the edge wrapping station.
Figure 8:
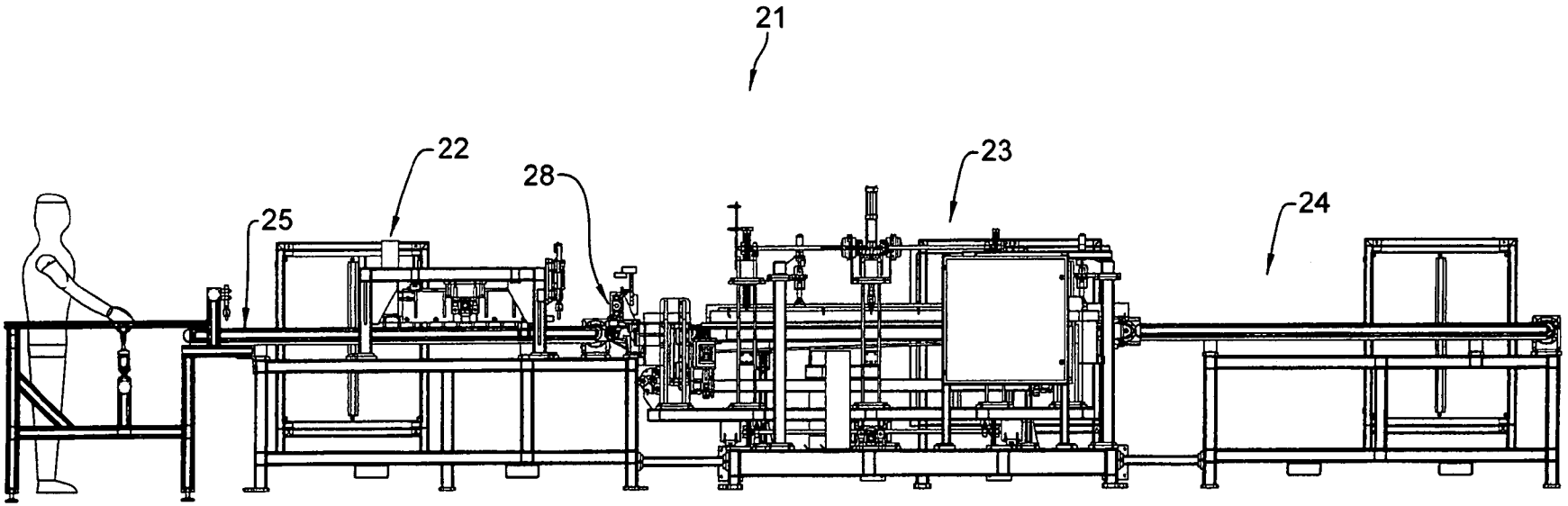
FIG. 8 is a right side elevational view of the arrangement shown by FIG. 6.
Figure 9:
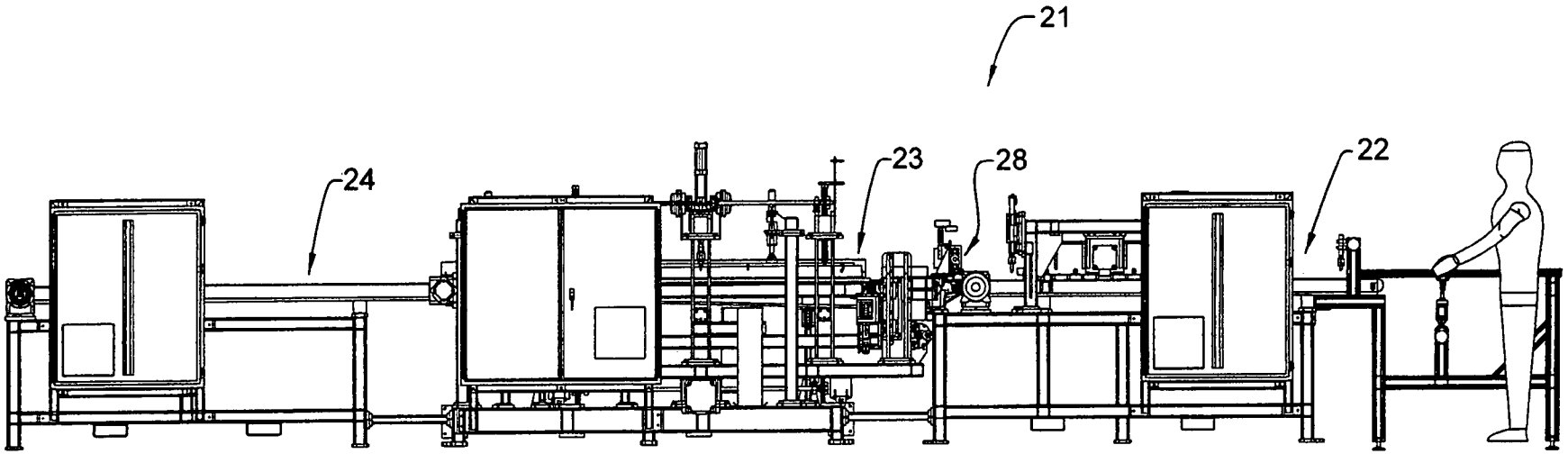
FIG. 9 is a left side elevational view of the arrangement.
Figure 20:
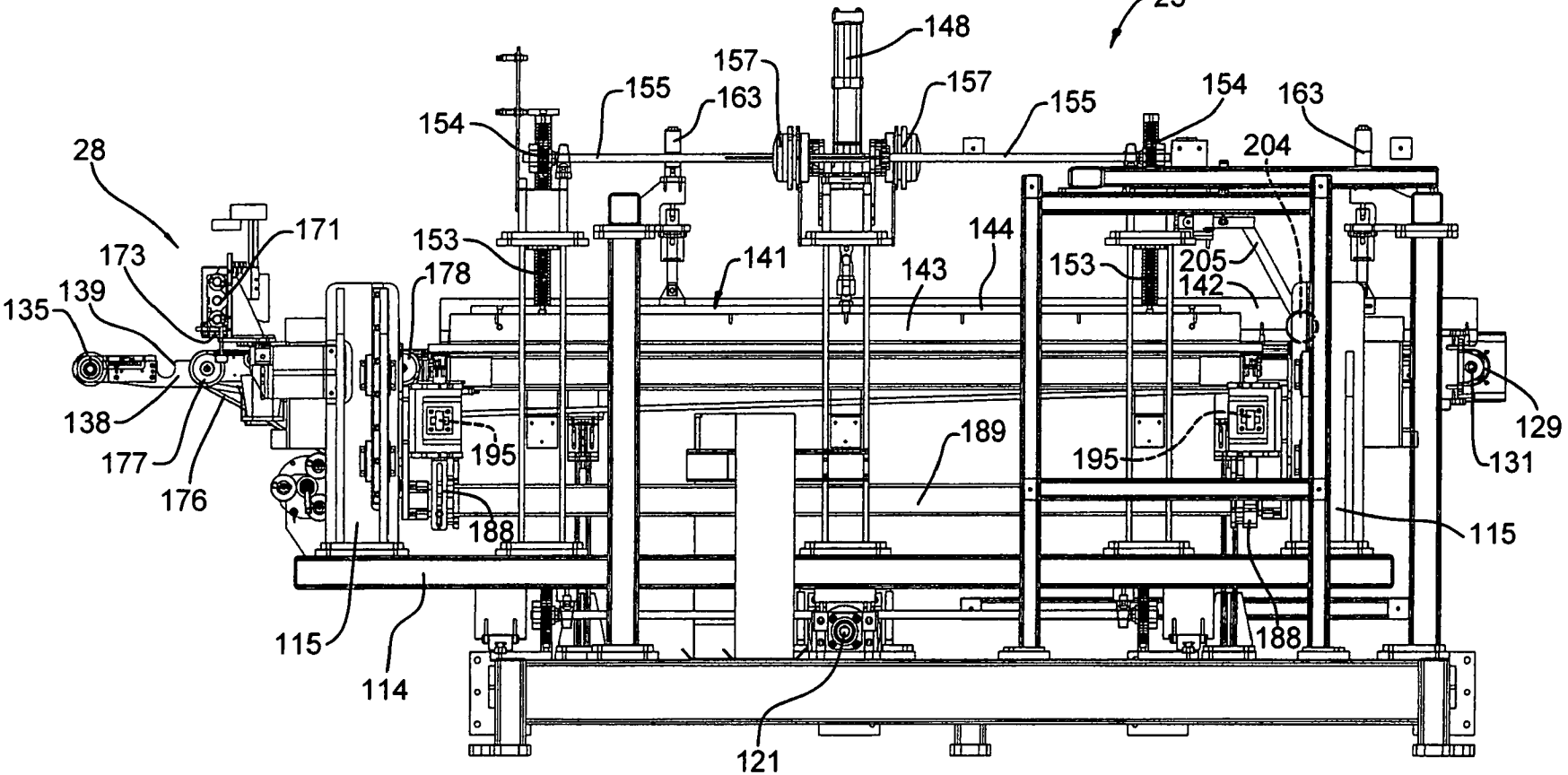
FIG. 20 is a right side elevational view of the edge wrapping apparatus shown in FIG. 17.
Figure 21:
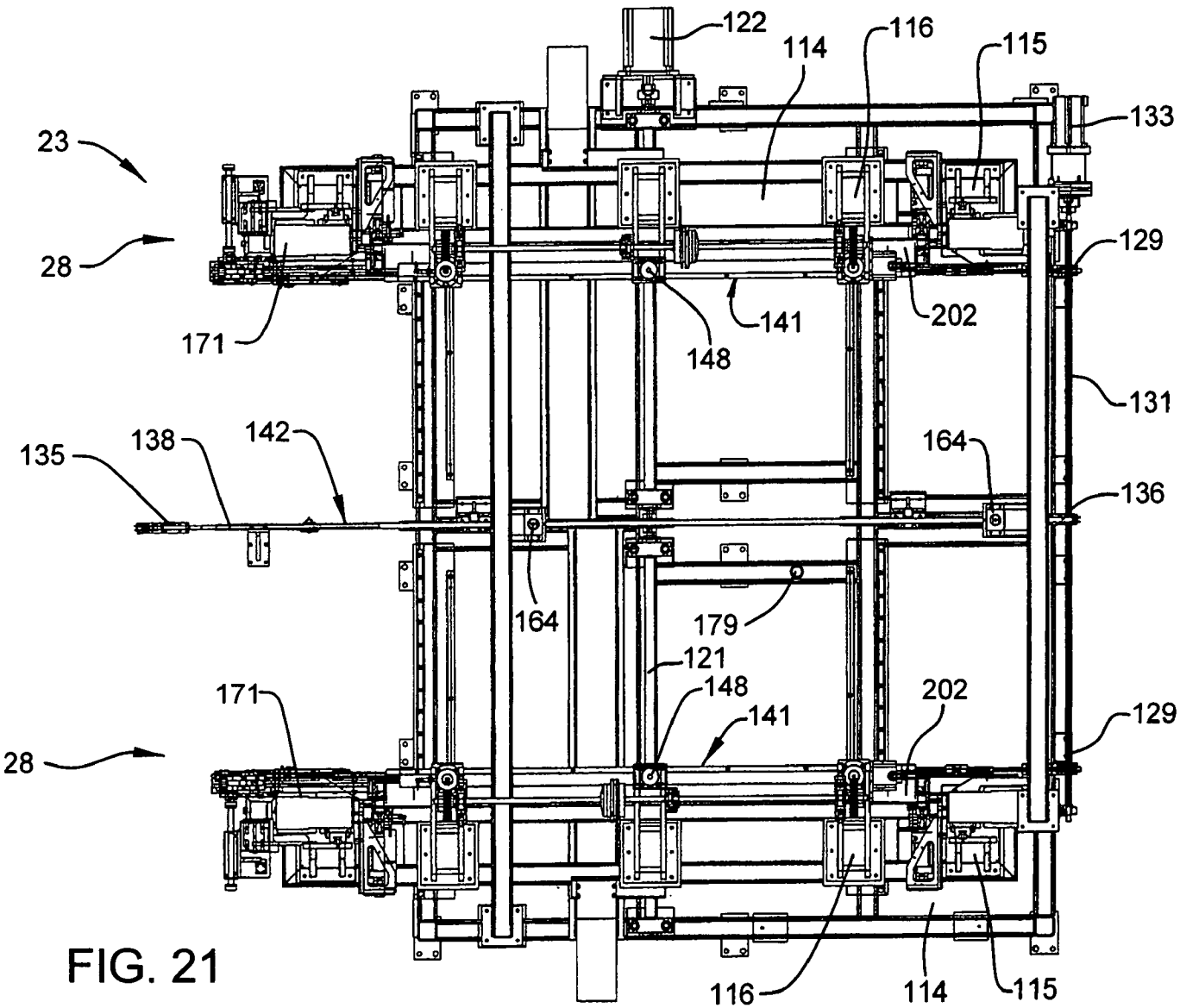
FIG. 21 is a top view of the edge wrapping apparatus shown in FIG. 20.
Figure 22:
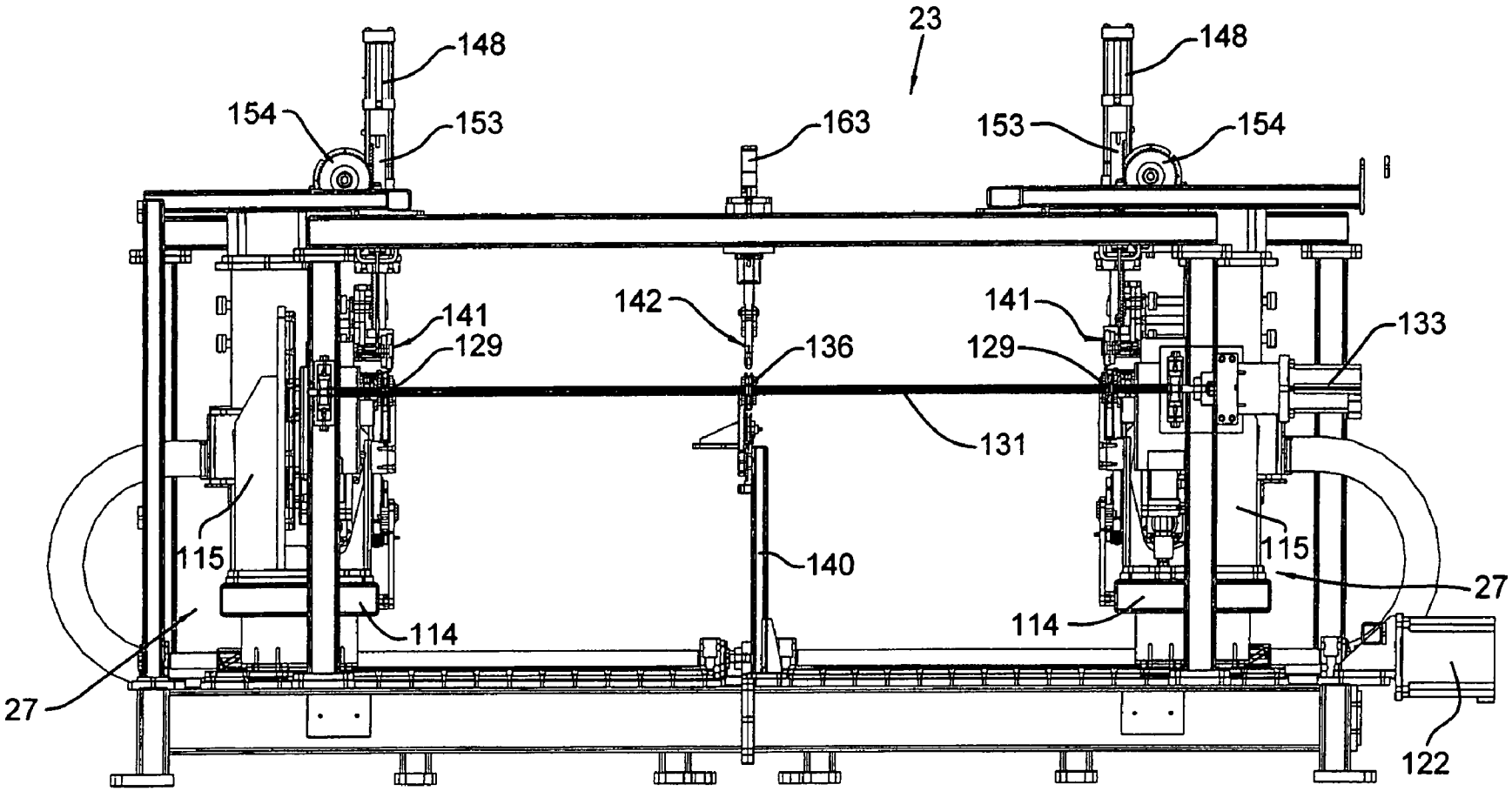
FIG. 22 is an end elevational view taken from the downstream end (the right end in FIG. 20) of the edge wrapping apparatus.
Figure 23:
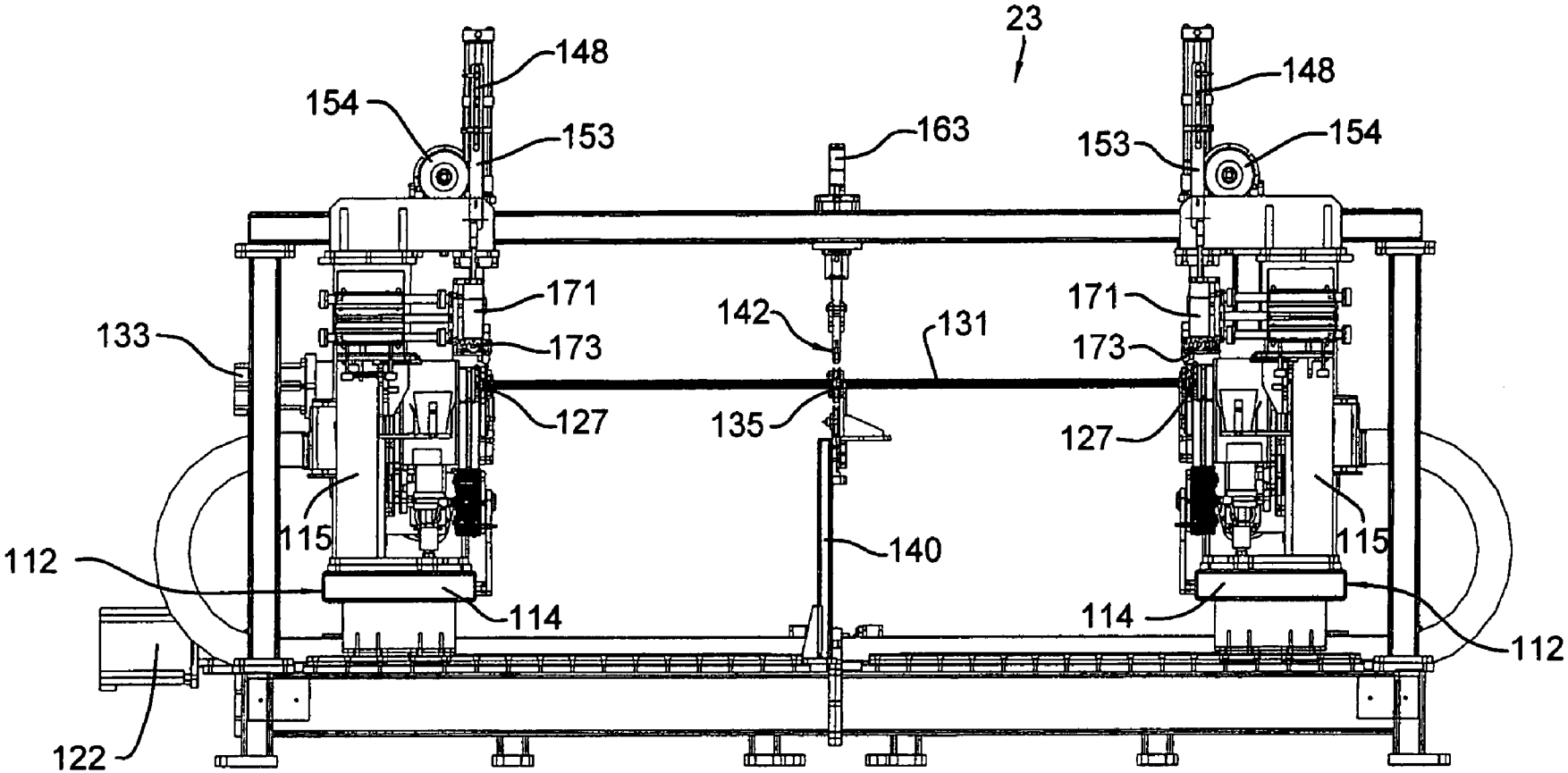
FIG. 23 is an end elevational view taken from the upstream end (the leftward end in FIG. 20) of the edge wrapping apparatus.
Figure 24:
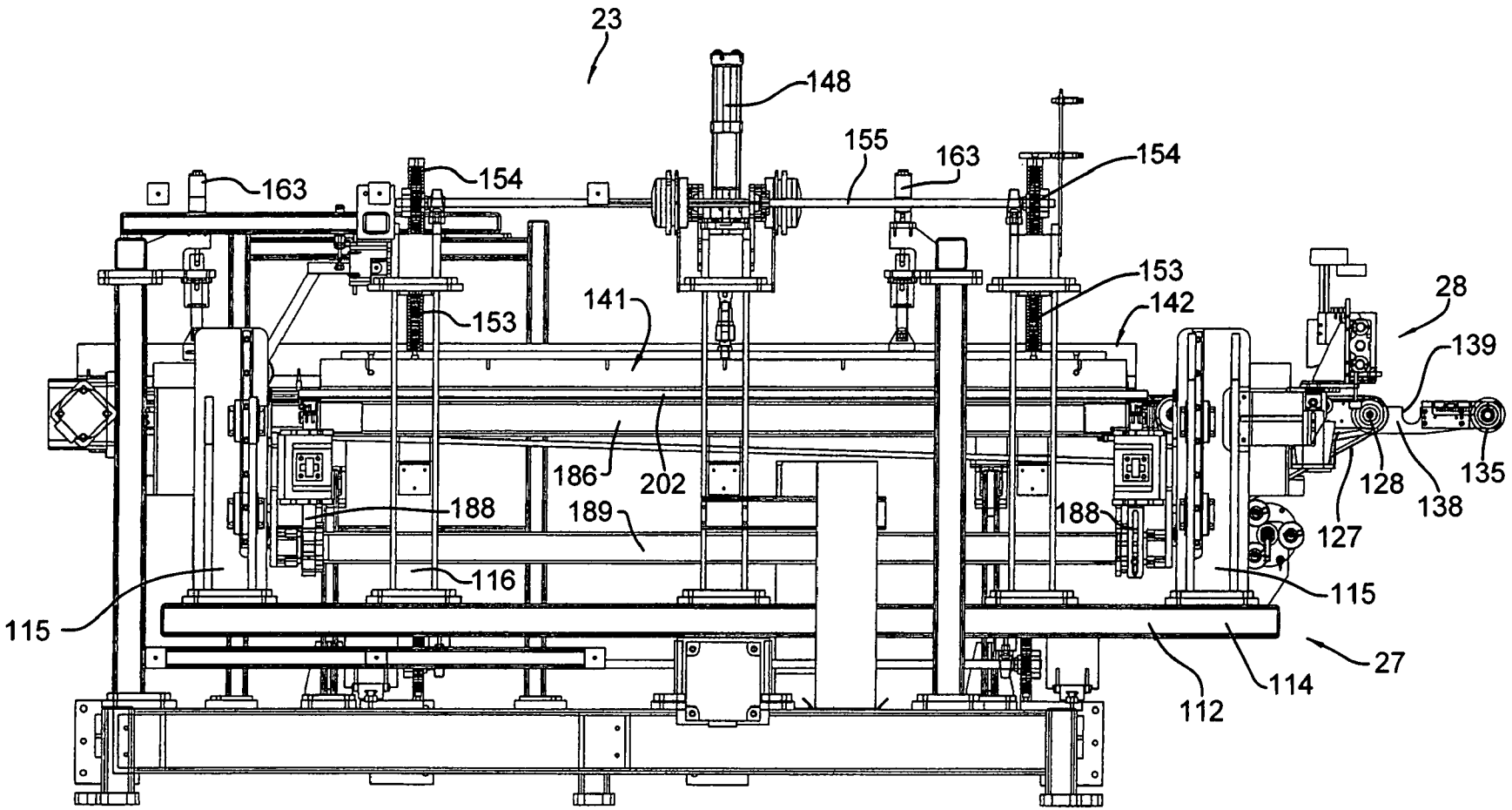
FIG. 24 is a left side elevational view of the edge wrapping apparatus.

The center drive belt 134 is also supported by an upright support plate 137 (FIG. 18) which is horizontally elongated so that the upper surface thereof effectively supports the upper reach of the drive belt 134, and the upstream and downstream ends of this support plate 137 having the belt support pulleys 135 and 136 rotatably supported thereon. The support plate 137 associated with the center drive belt arrangement 125, however, is of horizontally greater length than the side drive belt arrangements 126, whereby the upstream or rear end belt pulley 135 is not coaxially aligned with the upstream side pulleys 128, but rather is displaced outwardly (in the upstream direction) as illustrated in FIG. 20. This outward or upstream projection, as defined by the projecting end portion 138 of the support plate 137, enables the pulley 135 to be positioned generally within the narrow gap 36 defined between the sidewardly adjacent conveyor belts 32 associated with the infeeding device 22. In particular, and as illustrated in FIG. 7, the arm part 138 projects upstream a sufficient extent so as to enter into the gap 36 adjacent the downstream end of the conveyor belts 32 of the input apparatus 22, thereby positioning the belt pulley 135 within this gap at a location upstream of the discharge ends of the conveyor belts 32, but at a location disposed downstream from the stop gate 46. The position of the pulley 135, and its elevation, enables the upper reach of the center drive belt 134 to be substantially coplanar with the upper reaches of the drive belts 32 so that, when the workpiece is being moved forwardly for discharge from the drive belts 32, the workpiece automatically moves into engagement with the center drive belt 134 prior to leaving contact with the drive belts 32, thereby ensuring that the workpiece leading end is always positively engaged and moved forwardly due to its driving engagement with either the belts 32 or the center drive belt 134. The protruding bar part 138 is provided with a notch or recess 139 opening upwardly therefrom, which recess enables the bar part to fit around the transverse drive shaft associated with the drive pulleys 34 at the downstream ends of the drive belts 32.

The horizontally elongated support plate 137 associated with the center belt arrangement 125 is rigidly and stationarily supported by a plurality of uprights 140 (FIG. 18) which project downwardly from the support plate and are rigidly joined to the frame at their lower ends.

The edge wrapping apparatus 23 also includes an elongate clamp positioned for cooperation above each of the drive belt arrangements, including specifically a horizontally elongate side top clamp 141 positioned over and extending lengthwise along the upper reach of each of the side drive belts 127, and a elongate center top clamp 142 positioned over and extending lengthwise along the upper reach of the center drive belt 134. These three horizontally elongate clamps are all vertically movable between a lowered position wherein they are adapted to exert a hold-down force against a workpiece supported on the drive belts, and a raised clearance position.

The side clamps 141 as respectively associated with the side drive belts arrangements 126 are substantially identical and each includes a horizontally elongate clamp bar 143 which defines a clamping strip 146 along the lower edge which is adapted for pressing engagement against the back side of a workpiece substrate. For this purpose, the clamping strip 146 can be of a material such as a relatively hard polyurethane or rubberlike material but having at least limited resiliency or compressibility so as to avoid marking or damaging the workpiece. The clamping strip 146 can be detachably mounted on the bar 143 so as to be replaceable. Also, the clamping strip 146 can be provided with different cross-sectional shapes and widths so as to cooperate with the shape of the workpiece with which it engages. The horizontally elongate clamping bar 143 is elongated parallel with the adjacent upper belt reach through a significant horizontal extent, namely from a position spaced slightly rearwardly from the downstream discharge end of the belt to a position located upstream of an adhesive supplying station 28, as described hereinafter, whereby the clamping bar 143 will typically have a length which extends over a majority of the length of the adjacent upper belt reach. The clamp bar 143, at its upper edge, is fixed to an elongate top support bar 144, and the latter in turn is coupled to a driving device 148, such as a double-acting pressure (i.e. air) cylinder which controls raising and lowering of the clamp bar. The pressure cylinder 148 has a housing 149 thereof stationarily mounted on one of the uprights 116 associated with the respective side support 112, and the piston rod 151 of the air cylinder projects downwardly and is interconnected to the respective top bar 144.

The respective side top clamp 141 also has a pair of alignment arrangements 152 associated therewith, the latter including a pair of generally parallel guide bars 153 which are fixed to the top bar 144 adjacent opposite ends thereof. The guide bars 153 project vertically upwardly in parallel relationship and are provided with a gear rack along one side thereof. The gear racks on the guide bars 153 are disposed in meshing engagement with a pair of rotatable gears 154 which are rotatably supported on the uprights 116. The gears 154 in turn are non-rotatably coupled to shafts 155, which shafts can be suitable non-rotatably coupled together by a coupling 157. This ensures that the gears 154 always rotate synchronously and, due to their engagement with the guide racks 153, ensure that the clamp 141 maintains its horizontal orientation as it is raised and lowered, thereby providing proper clamping engagement of the guide bar with the workpiece in the lengthwise extent of the clamp bar.

The center clamp 142 is also formed as an elongate clamp bar 161 similar to the bar 143 described above, although the horizontal length of the center clamp bar 161 may be slightly greater than the length of the side clamp bars 143. The elongate center clamp bar 161 defines a clamp strip on the lower edge thereof similar to the side clamp bar 143. Center clamp bar 161 is raised and lowered by a pair of drive devices 163, such as a pair of double-acting pressure (i.e. air) cylinders. The cylinders 163 have the housings 164 thereof stationarily mounted on transversely-extending top cross beams 165 associated with the frame, whereby the piston rods 166 of the pressure cylinders project downwardly and couple to the center clamp bar 161 at locations positionable closely adjacent to the opposite ends thereof. The simultaneous activation of the cylinders 163 enables the center clamp bar 161 to be moved between a raised clearance position and a lowered position for clamping engagement with the back side of the workpiece substrate.

While the drive cylinders 163 are typically programmed to affect movement of the center clamp bar 161 solely between two end positions which represent the raised and lowered positions of the center clamp bar 161, the cylinders 148 which control raising and lowering of the side clamp bars 143 are programmed to move the clamp bar vertically between three positions, namely a first fully raised position wherein the clamp bars enable a workpiece to be moved thereunder for discharge from the machine, an intermediate raised position which enables a workpiece to be moved into position under the clamp bars for engagement with stop pins when reaching the edge wrapping position, and a lowered position wherein the clamp bars are positioned in clamping engagement with the back side of the workpiece substrate.

Each of the side clamp bars 14.3, in close proximity to the downstream end thereof, has a stop pin 158 (FIG. 27) mounted thereon. This stop pin 158 is carried on the clamp bar 143 by a suitable bracket 159 which positions the pin 158 in a sidewardly offset relationship so that the pin 158 is positioned sidewardly inwardly relative to the respective side conveyor belt. The pin 158 is cantilevered downwardly a sufficient distance so that the lower end of the pin protrudes downwardly below the lower edge of the respective clamp bar 143 so that, when the clamp bar 143 is in an intermediate raised position allowing movement of the workpiece thereunder, the pin 58 still projects downwardly a sufficient extent as to act as an abutment for engagement with the leading edge of the workpiece substrate when the latter is being moved by the belts into the edge wrapping position.

Each of the movable side supports 112, adjacent the upstream end thereof, also mounts thereon an adhesive application station 28 which includes an adhesive applicator 171 which is positioned sidewardly adjacent the upstream end of the respectively adjacent upper reach of the side conveyor belt 127. The adhesive applicator 171 is of conventional construction and is mounted on the adjacent corner upright 115 by a suitable support or mounting bracket 172. The applicator 171 defines thereon a downwardly directed spray nozzle 173 (FIG. 25) which is disposed closely adjacent but directly over the protruding side flap 14 so that the side flap, in the lengthwise extent thereof, moves under the spray nozzle 173 as the workpiece is fed into and moved lengthwise downstream of the edge wrapping apparatus 123 by the conveyor belts 127 and 134.

Figure 25:
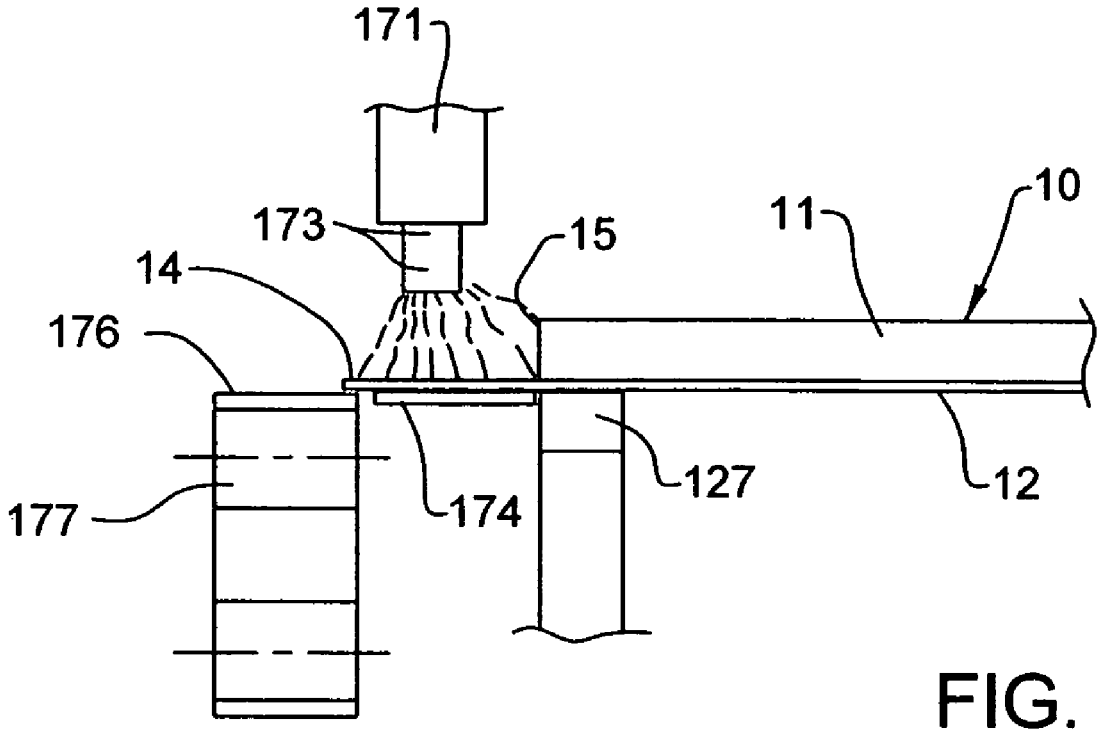
FIG. 25 is a schematic fragmentary enlarged view, in a plane transverse to the movement direction through the edge wrapping apparatus, and showing the cooperation of the adhesive spray nozzle with the protruding flap on the workpiece cover sheet.

As diagrammatically illustrated in FIG. 25, the workpiece 10 when fed into the edge wrapping apparatus 23 is positioned so that the upper reaches of the side drive belts 127 are disposed under the substrate directly adjacent the lengthwise extending side edge faces thereof, whereby the protruding side flaps 114 which extends along the lengthwise side edges of the substrate are disposed adjacent but sidewardly outwardly of the respective drive belt. To prevent downward drooping of the flap 14, particularly from a location downstream of the adhesive applicator 171 to a location adjacent the discharge end of the belts 32 associated with the infeeding apparatus 22, there is provided a stationary support plate 174 which is fixed relative to the respective support 112 and which is positioned and sized so as to enable the flap 14 to be slidably supported thereon while maintaining the flap in a horizontal and generally coplanar relationship with the cover sheet 12. In this orientation, the inside or back surface of the flap 14 is oriented upwardly so as to pass under the spray nozzle 173. During movement of the workpiece into the edge wrapping apparatus 23 and the consequent sliding advancing movement of the flap 14 along the guide plate 174, the applicator 171 is activated so as to discharge from the spray nozzle 173 a rather wide spray pattern of adhesive which effectively applies adhesive across the full width of the back side of the flap 14, and also preferably along the edge face 15 of the substrate. The adhesive discharged from the nozzle 173 may comprise a sprayable hot melt.

In addition, generally throughout the length of the support plate 174, there is provided an overspray belt 176, the upper reach of which extends between a pair of support pulleys 177 and 178 (FIGS. 20 and 25) so that any overspray is collected on the exposed upper surface of the belt 176. This belt 176 as it moves over the pulleys passes downwardly around a third pulley (not shown), and the latter pulley has a cleaning or wiping structure associated therewith to assist in removal of overspray from the belt 176.

Each of the movable side supports 112 also mounts thereon a wrapping unit 185 disposed downstream of the respective adhesive applicator 171. The wrapping unit 185 is positioned exteriorly sidewardly adjacent the respective side conveyor belt 127 and extends lengthwise along a substantial extent of the upper belt reach so as to act on an adjacent side edge of a workpiece when the latter is supported by the conveyor belts.

The wrapping unit 185 includes a horizontally elongate wrapping roll 186 (FIG. 26) which is supported for rotation about a horizontal axis which extends parallel to the longitudinal centerline 113 and is disposed in relatively close proximity to the adjacent upper belt reach of the side conveyor belt 127. This elongate roll 186 has an outer annular tread 187 which is preferably constructed of a relatively stiff rubber-like material such as a relatively stiff polyurethane which, when moved into engagement with the edge flap 14 of the cover sheet, will provide a secure slip-free engagement therewith. Alternately, the roller in its entirety may be made of such material.

The roller 186 is of significant axial extent, for example the roller preferably has an axial length which is similar to or only slightly smaller than the length of the respectively adjacent clamp bar 143, whereby the roller is suitable for accommodating adjacent workpiece side edges ranging from short to long.

The roller 186, adjacent opposite ends thereof is rotatably supported on upper ends of a pair of spaced but generally parallel swing arms 188, which arms at their lower ends are rigidly joined by a connecting shaft 189 which ensures that the pair of spaced arms 188 move synchronously. The opposite ends of the connecting shaft 189 are each rotatably supported on a support 191, the latter functioning similar to a nut in that it is engaged with a rotatable upright drive screw 193, the nut 191 and drive screw 193 a ball-screw which is confined within an upright housing 192 which is fixed to the adjacent upright corner upright 115. The rotatable drive screw 193 is drivingly interconnected, such as through an appropriate driving device such as a gear-and-tooth belt arrangement, to a drive shaft of an adjacent motor 194, such as a bi-rotational servomotor. Activation of the servomotors 194 and corresponding rotation of the drive shafts 193 cause the nuts 191 to be raised or lowered, depending on the direction of motor rotation, and hence cause the shaft 189 and the swing arms 188 to be moved between raised and lowered positions, the extremities of such positions being respectively illustrated by FIGS. 26B and 26.

To control swinging movement of the swing arms 188 about the horizontal axis of the support shaft 189, each swing arm 188 is inwardly biased by a biasing device 195, the latter preferably being a double acting pressure (i.e. air) cylinder. The pressure cylinder 195 in the illustrated arrangement has the housing 196 thereof disposed within a fixed enclosure 197, and the rearward end of the cylinder housing 196 is supported on the enclosure 197 by a horizontal pivot rod 198. The piston rod of the pressure cylinder 195 projects outwardly and is pivotally coupled to the respective swing arm 188 at a location spaced upwardly a substantial distance from the pivot axis defined by the support shaft 189. Energization of the pressure cylinder 195 to cause extension of the piston rod hence causes the swing arm 188 to swing inwardly so that, when the arm is in the lowered position illustrated by FIG. 26, the wrapping roller 186 is pressed into contact with an exterior side surface 199 defined on a vertical support plate 201, the latter being fixed to the exterior side of the conveyor belt support plate 130. The exterior side surface 199 of this plate, as illustrated in FIG. 27, is preferably disposed inwardly a small distance from the substrate side edge face 15.

The pair of swing arms 188 associated with each wrapping unit 185 as provided on each side support 112, which pair of parallel swing arms 188 are spaced a substantial distance apart in the lengthwise direction of the apparatus, are additionally provided with a generally flat support plate 202 which is mounted on the pair of parallel arms 188 adjacent the upper ends thereof, and which extends lengthwise between the pair of arms 188. This plate 202 is preferably disposed closely sidewardly adjacent, and at an elevation approximately corresponding to the adjacent upper reach of the conveyor belt 127, so that the sidewardly protruding cover flap 114 is supported on this plate 201 and hence is not permitted to droop or deflect downwardly. The support plate 201, at an upstream end, starts closely adjacent the downstream end of the transitional support plate 174 (FIG. 25) so as to ensure that the edge flap 14 is prevented from drooping downwardly during transference of the workpiece into the edge wrapping apparatus 23.

Figure 27:
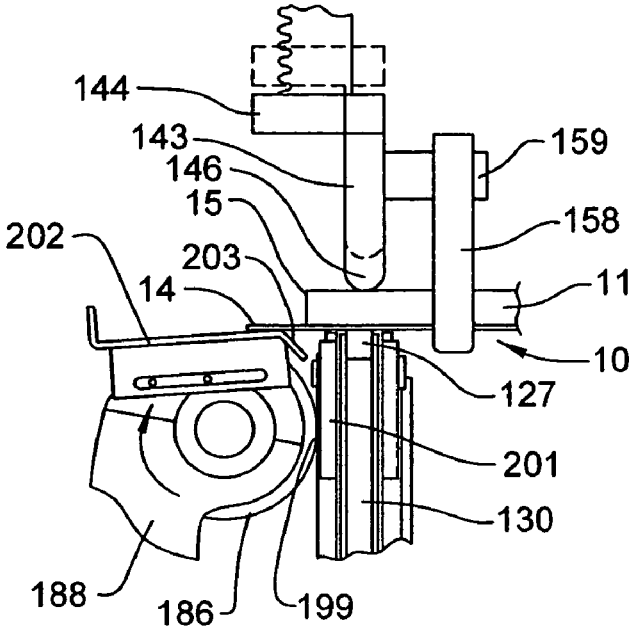
FIG. 27 is a fragmentary enlargement showing the position of the roller relative to the workpiece corresponding to FIG. 26, FIG. 27AA is an enlarged view showing the cooperation between the workpiece and roller when the roller initially contacts the lower outer corner of the workpiece.
Figure 27A:
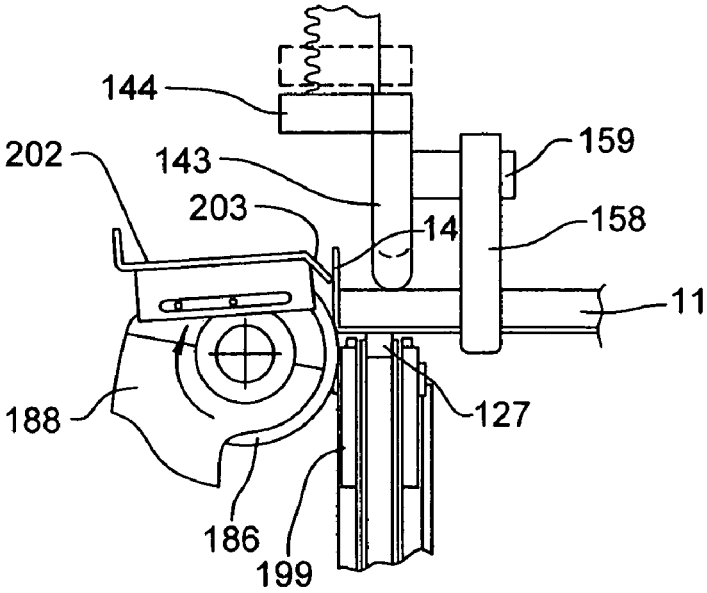
FIG. 27A is an enlargement showing the cooperation between the roller and the workpiece corresponding to FIG. 26A.
Figure 27A:
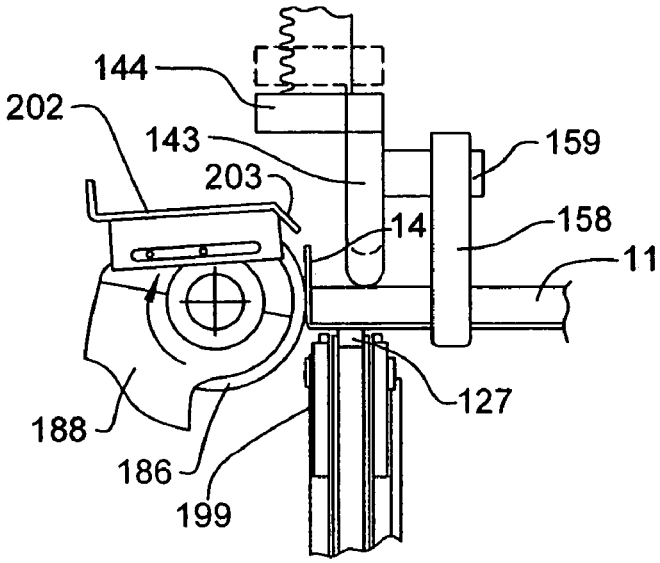

The support plate 201, along the lengthwise edge thereof closest to the conveyor belt, is preferably provided with a downwardly angled tab 203 which assists in effecting upward deflection of the cover sheet flap 14 during the edge wrapping process which is sequentially illustrated by FIGS. 27, 27AA, 27A and 27B.

Each of the movable side supports 112 may optionally be provided with a final pressing roller 204 (FIG. 18) positioned closely adjacent the downstream discharge end of the respective side conveyor belt arrangement 126. The pressing roller 204, which may have a stepped or shoulder profile on the periphery thereof, particularly if intended for cooperation with the back side of a workpiece similar to that illustrated by FIGS. 4 and 5, is rollingly support on the lower free end of a swingable support arm 205 (FIG. 17), the upstream end of the arm 205 being pivotably supported from the structure of the support 112. The pressing roller 204 and its swing arm are typically biased downwardly by a suitable biasing device, such as a spring (not shown), so that the periphery of the roller 204 can be urged into rolling engagement with the back surface of the substrate in the region where the back surface has the cover flap 14 wrapped therearound. The stepped profile of the roller enables the outer edge portion of the flap 14 to be pressed downwardly for adherence to the rear rail on the substrate substantially as illustrated by FIG. 5. Use of the pressure rollers 204 is optional, and such rollers can be swung upwardly and retained in a raised disengaged position if their use is not necessary, such as when the workpiece has a flat back surface as illustrated by FIG. 2.

Operation

The overall operation of the edge wrapping arrangement 21 will now be briefly summarized.

Figure 16:
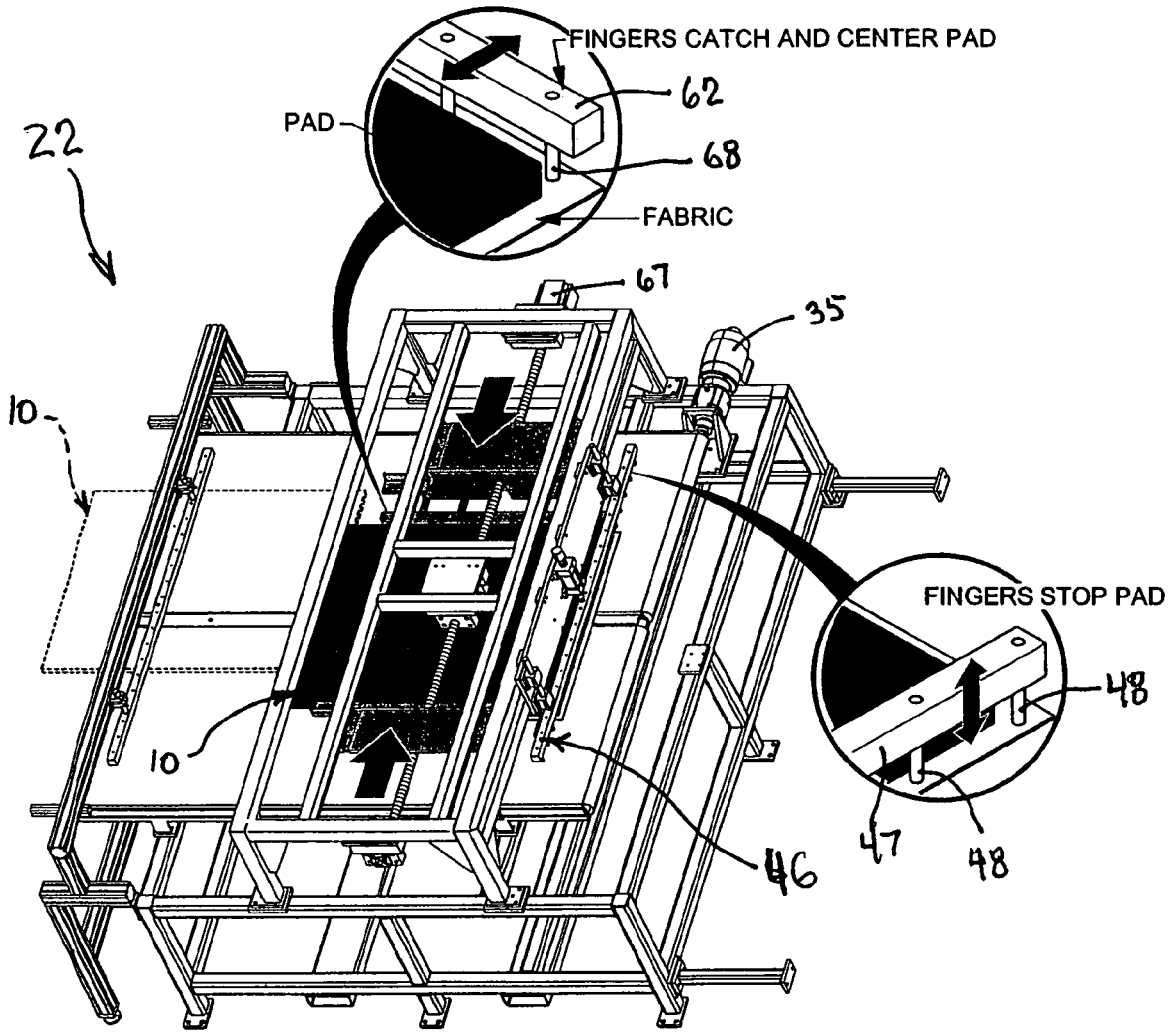

A workpiece similar to the workpiece 10 illustrated by FIGS. 1 and 2 will initially be positioned on the input table 38 so that the cover sheet 12 faces downwardly and engages the table surface 39. The workpiece will be positioned so that all of the cover flaps 14 are disposed so as to project outwardly in supportive engagement with the table surface. The workpiece can be manually moved forwardly until the leading edge face 15 of the substrate contacts the stop bar 41, in which position the leading cover flap 14 will be freely downwardly suspended. The table 38 is then swung downwardly so that the workpiece can pass beneath the stop gate 41. During this downward movement the suspended leading fabric flap 14 will engage the moving drive belts 32 and will be extended forwardly, followed by contact between the drive belts 32 and the main body of the workpiece in the vicinity of the leading edge of the substrate 11. This contact between the workpiece and the drive belts 32, either alone or in conjunction with an assisted pushing of the workpiece toward the drive belts 32, causes the workpiece to be moved onto the upper surface 33 of the moving drive belts 32 which then carry the workpiece forwardly until the leading edge of the substrate 11 contacts the stop pins 48 associated with the stop gate 46, the latter being in its lowered position. When this contact occurs, the leading cover flap 14 passes freely beneath the stop pins 48 and hence remains in a flat condition. If the workpiece upon contacting the stop bar 46 is slightly horizontally angularly displaced, then it will contact the stop bar adjacent one front corner thereof so that the continued forward driving of the workpiece by the belts 32 will cause the workpiece to self-align so that the front edge of the substrate 11, throughout substantially the full length thereof, moves into contact with the stop bar. When this latter position is sensed by the ultrasonic position sensor 69, the sensor 69 sends a signal to the controller which then deactivates the drive motor 35 and hence stops the conveyors belts 32 so as to prevent the belts from continually sliding against the exposed face of the cover sheet 12. The signal sent from the position sensor 69 to the controller also is used for activating the centering and sizing arrangement 56, specifically by activating the drive motor 67 which effects rotation of the drive shaft 64 which causes the right and left side guides 57 to be simultaneously and synchronously moved inwardly toward one another and hence inwardly toward an opposed side of the workpiece positioned therebetween. Since the workpiece which is abutted against the stop gate 46 may not be transversely centered relative to the longitudinal centerline 37, as illustrated in FIG. 16, the synchronous inward movement of the opposed side guide members 62 causes the pins 68 on one of the side guide members to initially contact the opposed side edge of the workpiece substrate, which pins due to their being raised relative to the conveyor belts will permit the side cover flap 14 to pass thereunder and hence remain flat on the conveyor belts. As the one side guide member 62 moves into contact with the opposed side face of the substrate, its contact sensor 63 is depressed and sends a signal to the controller that such contact has been initiated. The opposed side guide members 62 will continue to move inwardly toward one another, thereby pushing the workpiece sidewardly so as to effect centering thereof along the longitudinal centerline, until the other side guide member 62 moves into initial contact with the opposite side face of the substrate, which initial contact is sensed by depression of the contact sensor 63 associated with the other side guide member 62. When contact with the other side guide member occurs as sensed by its sensor 63, it also sends a signal to the controller indicating that both side guide members are now in contact, whereby the controller slows down the speed of the motor 67 and hence the speed of the side guide members 62. The side guide members will continue to move inwardly toward one another, at a reduced speed, until the two contact sensors 63 indicate that they are fully compressed, thereby indicating that the workpiece is now relatively securely positioned between the guide members 62 and hence is now sidewardly repositioned so that the lengthwise centerline of the workpiece is aligned along the longitudinal centerline 37 of the infeeding apparatus. At this point the drive motor 67 is stopped, and the workpiece is disposed in an infeed position so as to permit forward feed thereof to the edge wrap apparatus.

The signals from the contact sensors 63 which effect stoppage of the motor 67 also reflect the size (i.e. width) of the substrate 11 associated with the workpiece, and the controller utilizes this information to send an appropriate signal to the drive motor 122 associated with the edge wrapping apparatus 23 so that the motor 122 is energized so as to synchronously move the right and left side supports 112 either inwardly toward or outwardly away from one another to hence adjust the spacing between the side drive belt arrangements 126 to a distance which corresponds to (and is slightly less than) the transverse width of the workpiece substrate positioned in the infeeding apparatus 22.

The controller then again reactivates the motor 67, but in the reverse rotational direction, to cause the side guide members 62 to be moved outwardly a small distance, such as about $1\frac{1}{8}^{th}$ inch or so, away from the adjacent edge face of the substrate with which it was engaged. This hence maintains the side guide member 62 in close proximity for guiding purposes, without imposing unnecessary restraint or drag on advancing movement of the workpiece. The controller also maintains the sensors 63 in fully retracted positions.

After this slight retraction of the guide members 62 away from the sides of the workpiece substrate, the controller sends a signal to appropriate valving which activates the lifting cylinder 53 which raises the stop gate 46. Substantially simultaneously the controller send a signal to the drive motor 35 which activates the conveyor belts 32 so as to advance the workpiece forwardly beneath the raised stop gate 46, and also sends a signal to the main drive motor 133 which activates all of the drive belts 127 and 134 associated with the edge wrapping apparatus 23.

As the moving belts 32 advance the workpiece under the gate 46 and into engagement with the moving center drive belt 134 of the edge wrapping apparatus 23, and then into subsequent engagement with the side drive belts 127, the leading edge of the workpiece passes under and is sensed by the sensor 71, typically a laser sensor, and the latter sends a signal to the controller, which in turn sends a signal to the pair of adhesive applicators 171 so that, after an appropriate time delay which allows the leading edge of the sidewardly protruding cover flaps to move into position under the spray nozzles, activates the applicators 171 so that the spray nozzles 173 discharge a broad spray of adhesive, such as a hot melt, onto the upwardly facing back surface of the cover flaps 14, and also preferably along the adjacent longitudinally extending edge faces 15 of the substrate as well as along narrow strips of the back face as disposed adjacent the rear corners, as the workpiece is moved downstream of the apparatus 23 due to the workpiece being disposed in supportive engagement with the upper reaches of the driven conveyor belts 127 and 134. However, as the trailing edge of the workpiece passes beneath the sensor 71, this trailing edge is also detected and the sensor sends a further signal to the controller, which in turn transmits a signal to the adhesive applicators 171 so that, after the appropriate time delay, the adhesive applicators shut down and terminate spraying as the trailing edge of the side flaps 14 pass beneath the spray nozzles 173.

After the workpiece has moved forwardly of the apparatus 23 so that the entire length of the side flaps 14 have been sprayed with adhesive, the driving belts 127 and 134 continue to move the workpiece forwardly, and during this movement the side flaps 14 remain in a generally horizontal outwardly projecting orientation due to their being supported on either the support plate 174 as disposed in close proximity to the adhesive applicators, or on the support plates 203 which are carried on and extend between the upper ends of the swing arms 188. At this time the side top clamps 141 are maintained in an intermediate position wherein the lower clamp strips 146 are raised sufficiently above the conveyor belts as to permit free movement of the workpiece thereunder, but at the same time the stop pins 158 at the downstream end of the side clamp bars 143 project downwardly a sufficient extent as to be in a position for contacting the leading edge of the workpiece substrate.

As the workpiece is moved forwardly toward the stop pins 158 by the moving conveyor belts 127, 134, the leading edge of the workpiece passes over the sensor 179 which is positioned to detect the leading edge of the workpiece when it is a short distance from the stop pins 158. The sensor 179 transmits a signal to the controller, which in turn transmits a signal which reduces the speed of the drive motor 133, which speed is progressively slowed down so that the speed of the conveyor belts and of the workpiece carried thereon gradually slows down so that the conveyor belts and the workpiece effectively come to a stop substantially at a position wherein the leading edge of the workpiece contacts the stop pins 158, this being the edge wrapping position.

Upon stoppage of the workpiece and conveyor belts so that the workpiece is positioned at the edge wrapping station, as described above, the controller then activates the air cylinders 148 and 163 so that the side clamps 141 and center clamp 142 are lowered to engage and effect a downward clamping engagement with the substrate of the workpiece. The clamp bars 143 associated with the side clamps, in particular, are positioned so that they are disposed approximately directly over the respective side conveyor belts 127 and hence clampingly engage the substrate at a location which is close to but spaced slightly inwardly from the respective side edge face. The center clamp 142 also is positioned substantially directly over the center drive belt 134.

Figure 26:
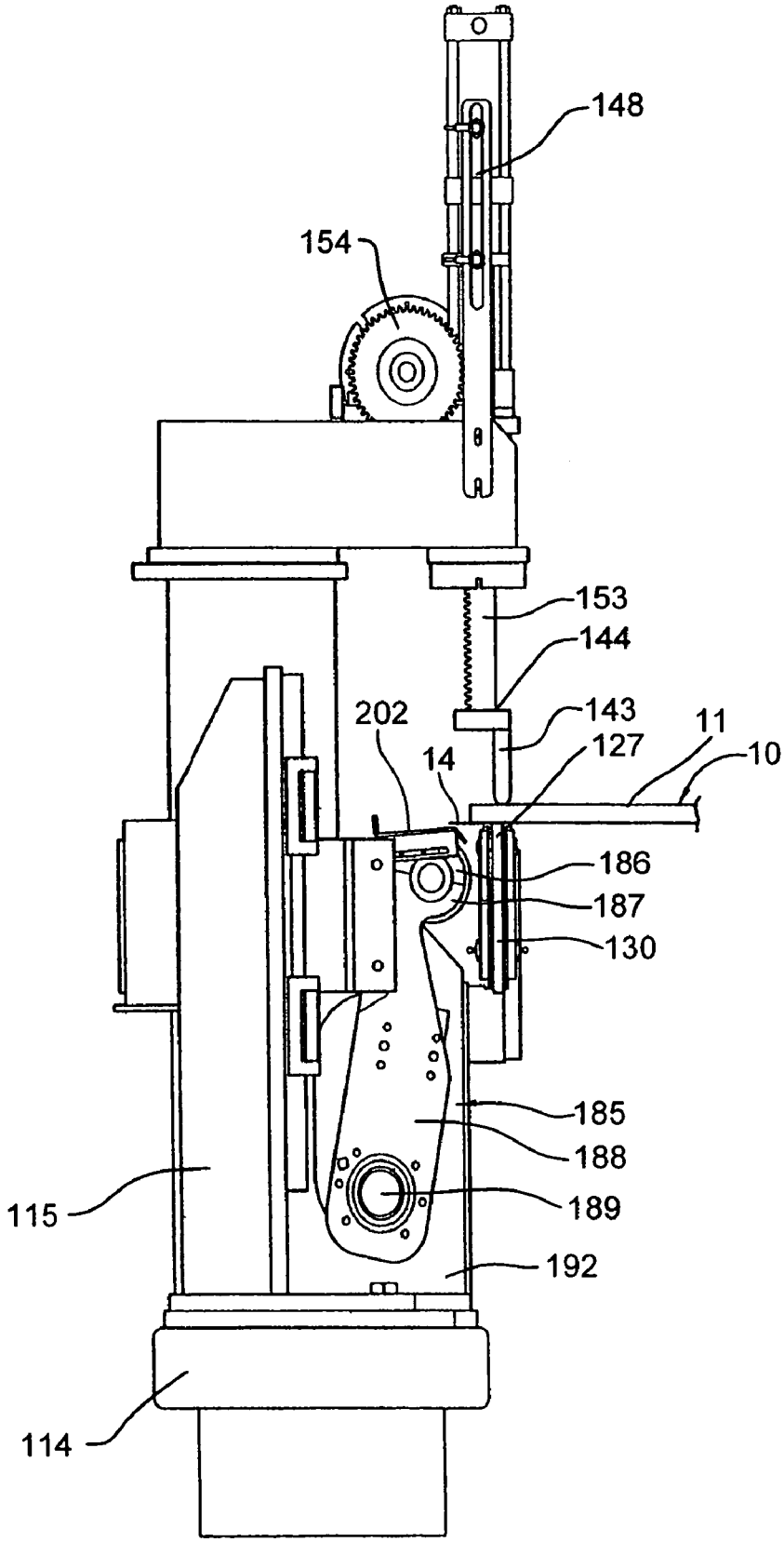
FIG. 26 is a generally end elevational view showing the edge-wrap roller arrangement in its lowered position.
Figure 26A:
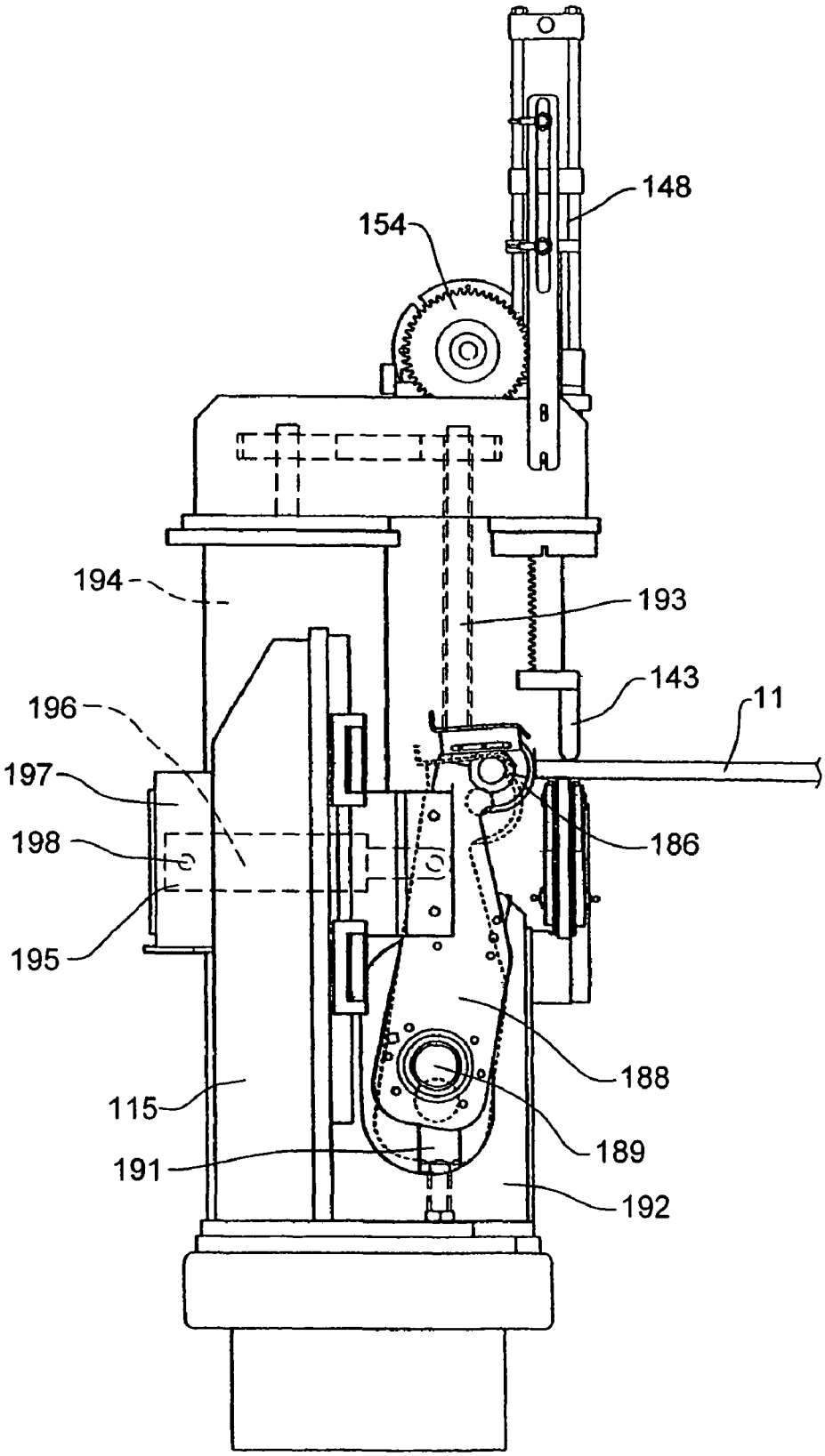
FIG. 26A is a view corresponding to FIG. 26 and showing the roller in a partially raised position for effecting rolling of the cover sheet flap against the side edge of the substrate.
Figure 26B:
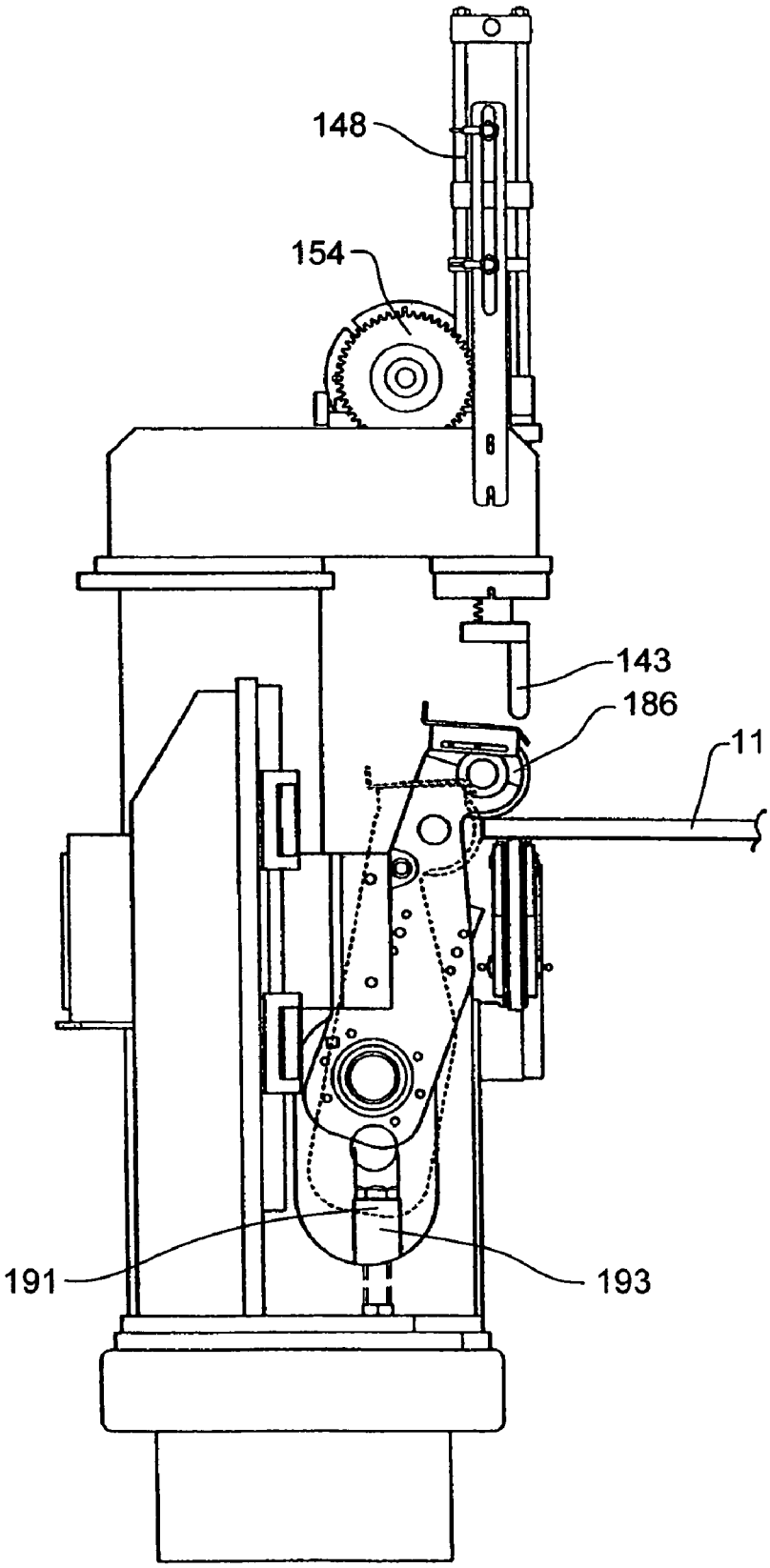
FIG. 26B is a similar view showing movement of the roller over the back side of the substrate.

With the clamps engaged with the workpiece, the controller activates the pair of sidewardly spaced wrapping units 185 which are mounted on the movable side supports 112. In particular, the air cylinders 195 are initially activated to ensure that the swing arms 188 are urged inwardly so that the wrapping rollers 186 are moved into contact with the side surfaces 199 of the support plates 201, substantially as illustrated by FIGS. 26 and 27. The controller then activates the servomotors 194 which effect rotation of the respective shafts 193 and cause lifting of the associated nuts 191, which in turn causes a slow controlled lifting of the support shaft 189 and of the two swing arms 188 coupled to the opposite ends thereof. As the swing arms 188 are initially lifted upwardly, while continuously being urged inwardly by the air cylinders 195, the roller 186 rolls upwardly along the support surface 199 toward the lower corner of the substrate-covered workpiece.

During the upward rolling of the roller 186 against the support surface 199, the top support plate 202 and its angled front flange 203 is moved upwardly along the edge face 15 of the substrate. Due to the close positional relationship of the flange 203 to the edge face 15, the flange 203 deflects the cover edge flap 14 upwardly and substantially wipes it into engagement with the edge face 15. The continued upward movement of the roller unit causes the roller 186 to make initial contact with the lower corner of the covered substrate, as illustrated by FIG. 27AA. The initial contact between the corner of the substrate and the roller, with the cover layer trapped therebetween, preferably occurs at a location which, relative to a horizontal diametral plane of the roller, is angled upwardly in the range of between about 15° and 45°. As a result of this contact, coupled with the continued upward movement of the swing arms 188, the roller 186 reacts against the corner of the workpiece and effects a small outward swinging movement of the swing arms 188 so that the roller 186 rollingly tracks upwardly and firmly presses the covering flap 14 into contact with the edge face 15, substantially as illustrated by FIG. 27A. The continued upward movement of the roller assembly causes the edge flap 14 to be securely pressed and effectively ironed onto the edge face of the substrate 11, and significant adherence thereto is achieved since adhesive generally has been previously applied both to the back side of the flap and to the edge face.

The continued upward movement of the roller 186, combined with the inward biasing thereof by the air cylinder 195, causes the roller 186 to roll upwardly toward the upper corner of the substrate. When the roller reaches an elevation where it begins to move inwardly as it rolls around the upper corner, the controller, based on the workpiece thickness signal received from the sensor 69, controls the servomotors 194 so as to significantly slow the upward lifting of the arms 188. The biasing cylinders 195 continue to urge the roller 186 inwardly so that it rolls over the back side of the substrate through a limited extent, substantially as illustrated by FIG. 27B, thereby ensuring that the outer edge portion of the cover flap 14 is pressed against and adhesively secured to the back side of the substrate.

Prior to the roller 186 being urged horizontally inwardly over the back surface of the substrate, based on the workpiece thickness signal from the sensor 69, the controller also activates the air cylinders 148 so that the side clamps 141 are raised upwardly from their lower clamping position into their uppermost position, in which position the clamp bars 143 and the stop pins 158 mounted thereon are disposed at a sufficient elevation so as to not interfere with the transverse inward movement of the roller 186 or the subsequent movement of the workpiece 10 in the discharge direction. The side clamp bars 143 are maintained in this upper end raised position while the rollers 186 are urged inwardly for pressing the fabric flaps 14 against the back side of the substrate as illustrated by FIG. 27B. During this inward rolling of the roller 186 in engagement with the back surface of the substrate 11, the servomotor 194 continues to operate at a significantly reduced speed to provide sufficient upward lifting of the control shaft 189 so as to compensate for and permit the necessary inward swinging of the arms 188 so as to permit the inward rolling of the roller 186 along the substrate back surface.

Figure 27B:
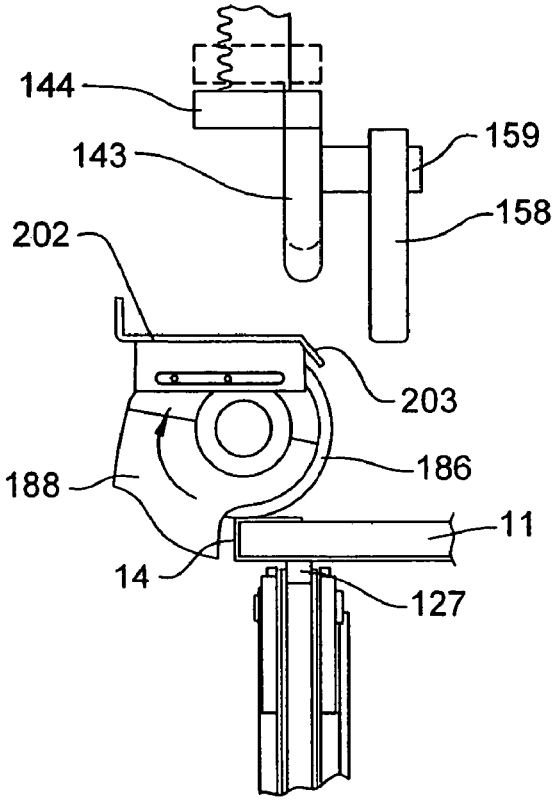
FIG. 27B is an enlargement showing the cooperation between the roller and workpiece corresponding to FIG. 26B.

When the servomotor 194 senses that the predefined lift height of the lift roller mechanism 185 has been achieved so as to permit the roller 186 to reach a terminal position, approximately as illustrated by FIG. 27B, the controller reversely activates the air cylinders 195 which swing the arms 188 outwardly to move the rollers 186 outwardly whereby they are disengaged from the workpiece, and the servomotors 194 are then reversely energized so that the arms 188 and the rollers 186 carried thereon are lowered back into their starting position substantially as illustrated by FIG. 26.

During or after lowering of the wrapping rollers 186 as described above, the controller also activates the air cylinders 163 to effect raising of the center clamp 142. This latter clamp is preferably maintained in clamping engagement with the workpiece until after the side clamps 141 are released so as to hold the workpiece in position and prevent any sticking of the workpiece to the side clamps.

The controller then activates the drive motor 133 which then drives all of the conveyor belts 127 and 134 so that the workpiece 10 is advanced forwardly (i.e. downstream) and is discharged to a suitable discharge or transfer station, as diagrammatically indicated at 24 in FIG. 6.

Substantially simultaneously with the discharge of the workpiece from the edge wrapping apparatus 23, the controller checks to determine if appropriate signals has been received from the contact sensors 63 so as to indicate not only the presence of the next workpiece at the infeed station of the infeed apparatus 22, but also the width of the next workpiece. If the workpiece at the infeed position is of different width, then the controller activates the motor 122 to adjust the side conveyors 126 either inwardly or outwardly to define a spacing therebetween which is programmed to correlate to the width of the incoming workpiece. When the new desired width between the belts 127 has been achieved, then motor 122 is stopped, and the controller transmits appropriate signals to the infeeding apparatus 22 so as to effect raising of the stop gate 46 and activation of the conveyor belts 32 to hence forwardly advance the next following workpiece from the infeeding apparatus 22 unto the moving conveyor belts of the edge wrapping apparatus 23. In addition, after a defined time sufficient to permit the workpiece with the wrapped edges to be discharged from the apparatus 23, the controller again activates the air cylinders 148 which effect downward displacement of the side clamps 141 into an intermediate position which, while the clamp bars are still raised sufficiently to permit the next workpiece to be moved into position thereunder, nevertheless the stop pins 158 protrude downwardly a sufficient extent so as to project into the path of the workpiece and hence function as the forward limit stop for defining the edge-wrapping position for the workpiece.

A preferred alternative process with respect to the edge wrappings sequence will now be briefly described.

Assuming that the workpiece has again been moved into position adjacent the stop pins 158 so that the drive belts and work surface are stopped, then the upward lifting of the roller arms 188 and the movement thereof from the lowered position of FIGS. 26-27 into the initial contact position of FIG. 27AA will occur prior to the top clamps 141 and 142 being lowered into engagement with the workpiece. When the rollers 186 move upwardly sufficiently to engage the lower edge corners of the workpiece substantially as illustrated by FIG. 27AA, if the workpiece 10 has become slightly sidewardly offset relative to the longitudinal centerline 113, then the engagement of the rollers 186 with the lower corners on opposite longitudinal edges of the workpiece 10 can effect recentering of the workpiece since the workpiece can move slightly transversely so as to assume a position of substantially equal engagement with the pair of rollers 186 as disposed on opposite sides thereof. When reaching this position as indicated at FIG. 27AA, then the servomotors 194 will be temporarily stopped or paused, and the controller at that time will activate the cylinders 148 and 163 so that all of the clamps 141 and 142 will be lowered into a position of clamping engagement with the back side of the substrate. The controller, after a suitable time delay sufficient to effect lowering of the clamps, will again activate the servomotors 194 so as to resume the upward listing of the rollers 186, which rollers 186 will again effect ironing or pressing of the adhesive-coated flaps 14 into engagement with the edge faces 15 and back side of the substrate in the same manner as described above.

Figure 28:
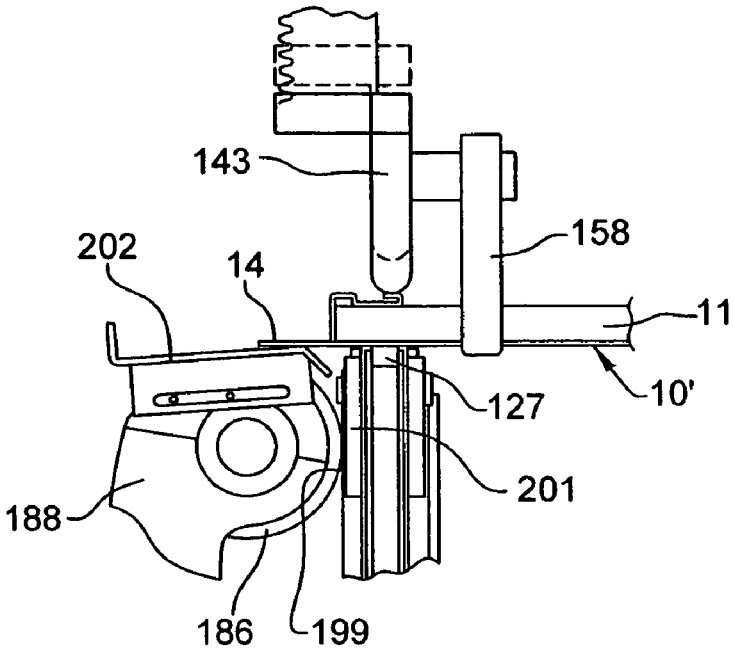
FIGS. 28, 28AA, 28A and 28B are fragmentary enlarged views which respectively correspond to FIGS. 27, 27AA, 27A and 27B but illustrate the wrapping roller cooperating with a workpiece of the type depicted by FIGS. 4-5.
Figure 28A:
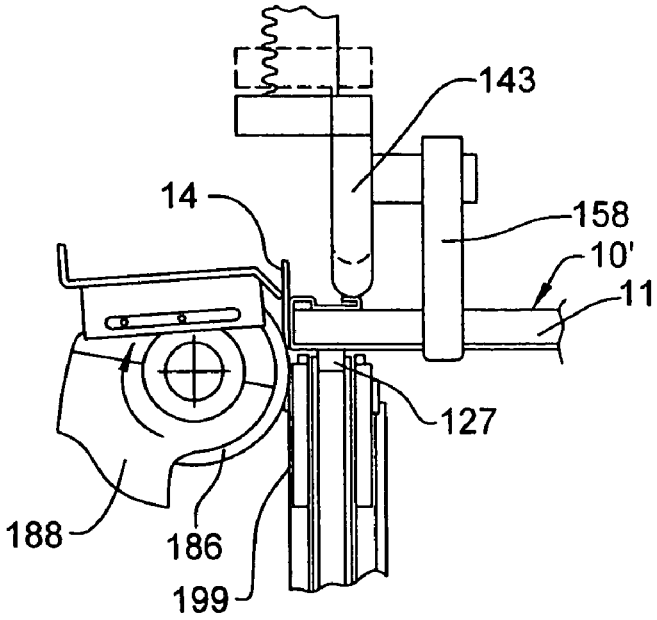
Figure 28A:
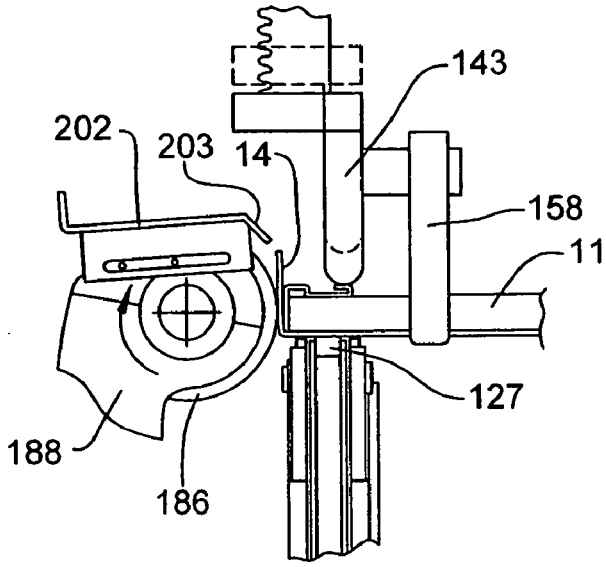
Figure 28B:
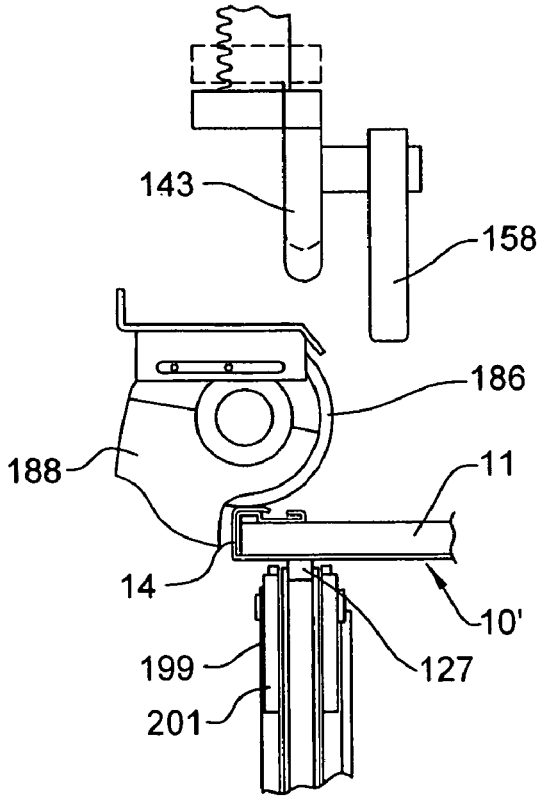

While the description above refers specifically to FIGS. 26 and 27 which diagrammatically illustrate the workpiece 10 of the type illustrated by FIGS. 1-3, it will be understood that the same operational description is equally applicable when the workpiece has a construction similar to that illustrated in FIGS. 4-5. In this regard, reference is made to FIGS. 28-28B which correspond to FIGS. 27-27B but which illustrate a workpiece 10' of the type depicted by FIGS. 4-5.

Regarding the discharge or transfer station 24 as illustrated in FIG. 6, this station may comprise a stationary table on which the finished workpiece is discharged, with the finished workpiece being handled either manually or automatically in whatever manner is suitable so as to permit further processing thereof. Alternately, the transfer station may include conveyor belts which are activated when the discharged workpiece is positioned thereon so as to permit transport of the workpiece to a subsequent processing station.

Since the operation as described above relates to wrapping of only an opposed pair of side edges of the workpiece, and since most workpieces have flaps protruding from all four side edges thereof, it will be appreciated that the finished workpiece as described above can be processed through the apparatus a second time merely by rotating the workpiece 90° so that the previously leading and trailing flaps now protruding sidewardly, with the workpiece then again being fed into the apparatus and fed therethrough so as to permit the remaining pair of cover flaps to be adhesively secured in the same manner described above.

In a preferred construction, however, there is preferably provided a second edge wrapping arrangement which can be substantially identical to the arrangement illustrated in FIG. 1, with the second arrangement being located downstream of the first arrangement so that after the workpiece passes through the first arrangement and has one pair of side flaps wrapped, the workpiece is then fed through a second arrangement which effects wrapping of the other pair of side edges in the same manner. The workpiece discharging the second edge wrapping arrangement thus will have all four side edges appropriate wrapped, following which the excess material located at the corners can then be either manually or automatically tucked upwardly and around the corner so as to permit securement to the back side in a manner as described with respect to FIGS. 1-5.

Figure 29:
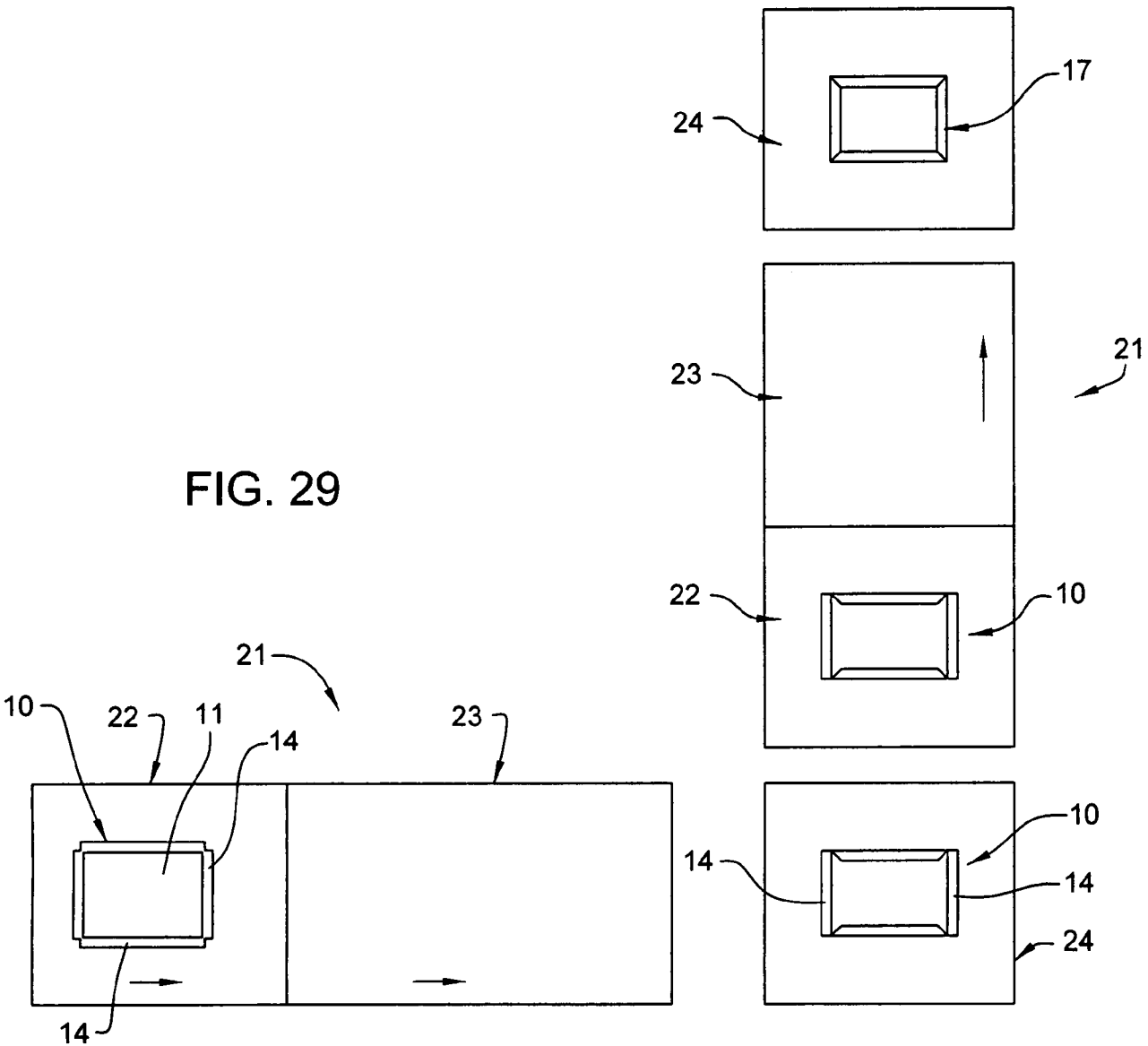
FIG. 29 diagrammatically illustrates a two-stage edge wrapping arrangement.
Figure 30:
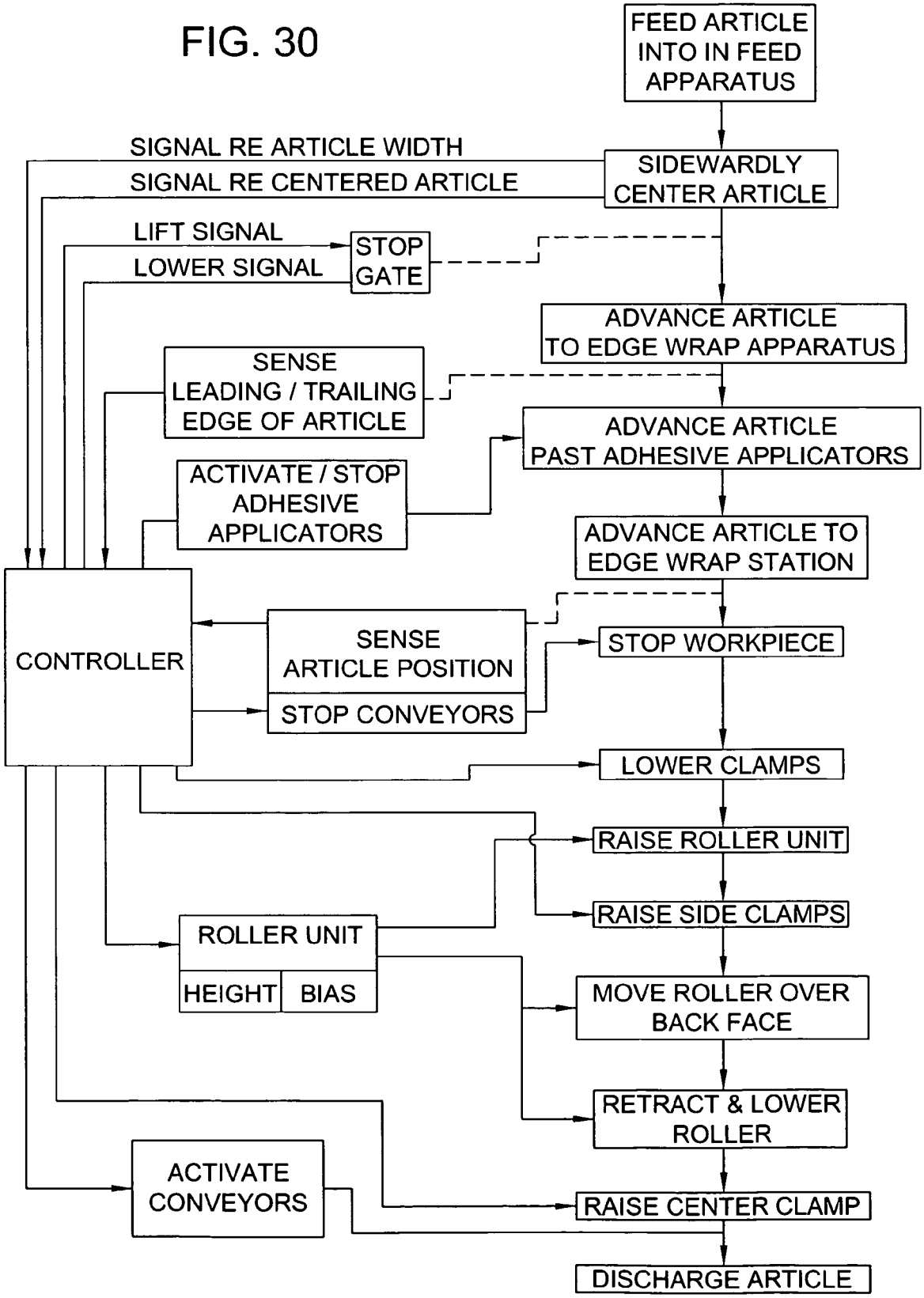
FIG. 30 is a flowchart which diagrammatically illustrates the operation of the present invention.

With respect to this latter two stage process, reference is made to FIG. 29 which diagrammatically illustrates a four sided workpiece which is fed through a first edge wrapping apparatus 21 so as to wrap one opposed pair of edge flaps, with the discharge workpiece then being fed into a second apparatus 21' which is perpendicularly oriented with respect to the first apparatus so that straight inward feeding of the workpiece is then effective for wrapping the remaining pair of edge flaps.

In the process and apparatus of the present invention, the edge flaps of a cover sheet can be efficiently and effectively wrapped around a pair of opposite elongate and substantially parallel edges of a substrate, with the wrapping and securing of the edge flaps being carried out in a substantially wholly automated manner. The invention is particularly desirable for rectangular-shaped articles (i.e., pads with a continuation of long and short edges, or all equal length edges) since the process enables the two opposed pairs of parallel edges to be sequentially and substantially automatically wrapped by submitting the article to two sequential wrapping stages which are defined either within one machine or by two sequential machines.

The process and apparatus also enables the wrapping of edges which are short, for example about one foot long, and also permits wrapping of long edges, such as six to eight foot long. The ability to wrap long edges is particularly desirable since edges are extremely difficult to wrap using conventional manual wrapping techniques.

The apparatus of the invention also readily accommodates and wraps edges of different sized articles as fed sequentially into the machine, thereby providing an efficient but flexible manufacturing process.

Reference to the cover sheet, as discussed herein, will be understood to include all suitable and/or conventional thin sheetlike covering materials possessing flexible or bendable properties so as to perform the desired functions when used as part of a workpiece, and specifically will include fabric, cloth, textile, foil, plastic or other suitable sheetlike materials. The word "fabric" when used herein, will be understood to include cloth or textile within the scope thereof.

While the invention as illustrated in the drawings discloses wrapping an edge face which extends generally perpendicularly between front and rear faces of the article, the invention is also useable when the edge face has a sloped or chamfered shape, including a multi-faceted edge face, or when the edge face includes rounded corners of either small or large radius, since the pressure cylinders 195 which urge the rollers into tracking engagement with the edge faces can be controlled by the controller so as to follow the edge face contour.

The article or workpiece on which the edges are being wrapped may assume a significant number of shapes, sizes and uses, including cover tiles or pads for upright walls, wall panels, tackboards, cores for wall panels, and miscellaneous similar articles.

It will be recognized that numerous variations in both the structure and process can be made without departing from the inventive aspects and scope of the invention.

What is claimed is:

1. A process for wrapping opposite edges of a substrate, comprising the steps of:

providing a workpiece defined by a substrate having a pair of generally parallel edge faces and a thin flexible fabric cover sheet positioned in overlying relationship to a front face of said substrate and having a pair of flexible fabric flaps each of which extend along and protrude outwardly beyond a respective one of said substrate edge faces;

providing an edge wrapping apparatus having a conveying system for supporting a workpiece thereon and for effecting generally linear movement of the workpiece lengthwise of the apparatus from an input end to an output end thereof;

providing the edge wrapping apparatus with a pair of roller units positioned adjacent opposite sides of the conveying system and each including an axially elongate roller disposed to extend along one side of the conveying system and supported for rotation about an axis which is substantially parallel to the direction of movement of the workpiece when supported on the conveying system;

positioning the workpiece on the conveying system so that the flexible cover is engaged with upwardly-facing support surfaces associated with the conveying systems;

moving the conveying system, and the workpiece supported thereon, past a sidewardly spaced pair of adhesive applicators;

supporting the flexible fabric flaps on upwardly-facing supporting walls so that the flaps protrude outwardly and the back surfaces thereof face upwardly as the conveying system moves the workpiece past the adhesive applicators;

activating the adhesive applicators as the workpiece is moved therepast to effect application of adhesive to the back surface of both sidewardly protruding flaps substantially throughout the length thereof as the workpiece is moved past the adhesive applicators;

continuing the movement of the conveying system so that the workpiece is moved into a wrapping position which is located downstream of said adhesive applicators and is defined between said rolling units, and stopping the movement of the workpiece;

supporting the edge flaps at the wrapping positions on flap support members which are disposed under the edge flaps adjacent opposite sides of the workpiece to maintain the edge flaps in an outwardly protruding orientation and prevent the flaps from hanging downwardly;

transversely deflecting the sidewardly protruding flaps upwardly into positions adjacent the respective edge faces of the substrate by moving the flap support members upwardly past the adjacent edge face;

moving the roller units transversely relative to the roller axis so that the rollers contact and rollingly move upwardly across the respective edge faces to cause the upwardly deflected flexible fabric flaps to be pressed thereagainst and adhesively secured thereto, and then moving the rollers inwardly over the back face of the substrate to cause end portions of the flaps to wrap around and be pressed against and secured to the back face in the vicinity of the respective edge faces;

thereafter moving the roller units out of engagement with the workpiece; and then moving the conveying system and the workpiece supported thereon forwardly away from the edge wrapping position.

2. The process according to claim 1, including the steps of:

providing the roller unit with a deflector plate at a position directly above the roller and connected thereto for transverse displacement with the roller, supporting the respective protruding flexible edge flaps on upper surfaces of the deflector plates when the workpiece is moved into the wrapping position, and deflecting the flap transversely into a position adjacent the respective edge face as the roller is moved upwardly for engagement with the edge face.

3. A process for wrapping opposite edges of a substrate, comprising the steps of:

providing a workpiece defined by a substrate having a pair of generally parallel edge faces and a thin flexible fabric covering sheet positioned in overlying relationship to a front face of said substrate, the flexible fabric covering sheet having a pair of flexible fabric edge flaps which extend along and protrude outwardly beyond a respective one of said parallel substrate edge faces;

positioning the workpiece on a support arrangement so that the flexible fabric covering sheet is supported on an upwardly-facing support surface defined on the support arrangement;

activating adhesive applicators to effect application of an adhesive to an upwardly-facing back surface of both sidewardly protruding fabric edge flaps substantially throughout the length thereof;

supporting the fabric edge flaps from the underside thereof as the adhesive is applied thereto so as to maintain the edge flaps in generally flat and outwardly protruding relationship along opposite edge faces of the workpiece;

providing a pair of edge-wrapping units disposed adjacent opposite edges of the workpiece, as supported on the support surface, for acting on the respectively adjacent protruding edge flaps after the adhesive has been applied thereto;

providing each said edge-wrapping unit with a pressing structure constructed of a stiff but resilient material;

providing each said edge-wrapping unit with a top support plate disposed at a position above the respective pressing structure and defining thereon an upwardly facing surface for contacting and supporting the outwardly protruding fabric edge flap to prevent the fabric edge flaps from hanging downwardly;

moving the edge-wrapping unit generally vertically upwardly past the respective edge face so that the top support plate and the pressing structure deflect the edge flap upwardly across the edge face and a side contact surface of said pressing structure presses the edge flap toward the edge face of the workpiece so that the edge flap is adhesively secured thereto;

continuing the upward movement of the edge-wrapping unit until the contacting side surface of the pressing structure moves vertically across substantially the full height of the edge face;

then moving the pressing structure inwardly over an upward-facing back side of the workpiece (1) so that the pressing structure deflects an upwardly protruding edge portion of the edge flap downwardly and (2) a down-facing contact surface on said pressing structure engages and presses the edge portion into adhesive securement with an upwardly-facing back surface of said workpiece; and then returning the edge-wrapping unit back to its initial position.

4. A process for wrapping opposite edges of a substrate, comprising the steps of:

providing a workpiece defined by a substrate having a pair of generally parallel opposite edge faces and a thin flexible cover sheet of fabric or foil positioned in overlying relationship to a front face of said substrate and having a pair of flexible edge flaps each of which extends along and protrudes outwardly beyond a respective one of said opposite edge faces;

positioning the workpiece in an up-facing position, in which the flexible cover sheet faces downwardly, on an upwardly-facing supporting surface of a support;

supporting the flexible edge flaps on an up-facing flap support arrangement so that the flexible edge flaps protrude generally horizontally outwardly from the respective substrate edge faces and are not permitted to hang downwardly;

providing a pair of roller units positioned adjacent opposite sides of the support and each including an axially elongate roller extending along one side of the support and supported for rotation about a generally horizontal axis which is parallel to the lengthwise direction of the adjacent edge flap and positioned at a location below the respectively adjacent protruding edge flap;

providing a pair of adhesive applicators positioned adjacent opposite sides of the workpiece;

activating the adhesive applicators as the workpiece and adhesive applicators are relatively moved lengthwise of the edge flaps to effect application of adhesive to an upwardly-facing back surface of both sidewardly protruding edge flaps substantially throughout the lengths thereof;

then transversely deflecting the sidewardly protruding edge flaps upwardly into positions adjacent the respective edge faces by moving a part of the flap support arrangement upwardly and transversely across the adjacent edge face of the workpiece;

simultaneously moving the roller units transversely upwardly relative to the roller axis and relative to the adjacent edge face so that the rollers simultaneously contact and rollingly move transversely upwardly across the respective edge faces to apply pressure against the opposite edge faces and cause the edge flaps to be pressed thereagainst;

then moving the rollers inwardly over the back face of the workpiece to cause upper end portions of the edge flaps to wrap around and be pressed against the back face of the workpiece in the vicinity of the respective edge faces; and thereafter moving the roller units out of engagement with the workpiece.

* * * * *